US009851072B2

(12) United States Patent
Wagemans et al.

(10) Patent No.: US 9,851,072 B2
(45) Date of Patent: Dec. 26, 2017

(54) ARRANGEMENT FOR CHANGING THE VISUAL APPEARANCE OF A TARGET OBJECT

(71) Applicant: PHILIPS LIGHTING HOLDING B.V., Eindhoven (NL)

(72) Inventors: Wiebe Wagemans, Eindhoven (NL); Helena Bernadette Jos Plasschaert, Waalre (NL); Kars-Michiel Hubert Lenssen, Veldhoven (NL); Dragan Sekulovski, Eindhoven (NL); Ralph Kurt, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 90 days.

(21) Appl. No.: 14/782,824

(22) PCT Filed: Apr. 8, 2014

(86) PCT No.: PCT/EP2014/057014
§ 371 (c)(1),
(2) Date: Oct. 7, 2015

(87) PCT Pub. No.: WO2014/166930
PCT Pub. Date: Oct. 16, 2014

(65) Prior Publication Data

US 2016/0025304 A1 Jan. 28, 2016

(30) Foreign Application Priority Data

Apr. 9, 2013 (EP) ..... 13162860

(51) Int. Cl.
*F21V 9/16* (2006.01)
*F21V 9/00* (2015.01)
(Continued)

(52) U.S. Cl.
CPC ..... *F21V 9/16* (2013.01); *F21S 8/046* (2013.01); *F21S 10/023* (2013.01); *F21V 9/00* (2013.01);
(Continued)

(58) Field of Classification Search
CPC .... F21Y 2113/10; F21Y 2113/13; F21V 9/00; F21V 9/16; F21V 14/02; F21S 8/046; F21S 10/023; G09F 13/02
See application file for complete search history.

(56) References Cited

U.S. PATENT DOCUMENTS 2,040,538 A * 5/1936 Smith ..... G09F 19/00 40/443
4,703,572 A * 11/1987 Chapin ..... G09F 13/42 250/461.1
(Continued)

FOREIGN PATENT DOCUMENTS

DE 102011000657 A1 8/2012
EP 2555261 A1 2/2013
(Continued)

OTHER PUBLICATIONS

Johanna Enger; "Dynamic Colours in Dynamic Light", Clour and Light in Architecture, First International Conference Proceedings, 2010, pp. 206-211.

*Primary Examiner* — Alexander Garlen

(57) ABSTRACT

The invention relates to an arrangement (100) comprising a lighting system (110) and a target object (120), wherein the lighting system (110) is arranged to illuminate a target surface of the target object (120) with a primary light output (111) and with a secondary light output (112). Each of these light outputs has an illumination spectrum representing a color. The two illumination spectra are different, but the two colors are substantially the same. The target surface has a first target surface area and a second target surface area.
(Continued)

When the first and second target surface areas are illuminated with the primary light output (111), they have a contrast that is lower than when they are illuminated with the secondary light output (112). The arrangement of the invention can be used for atmosphere creation or for attracting attention to the target object (120).

15 Claims, 12 Drawing Sheets

(51) Int. Cl.

| | |
|---|---|
| ***F21V 14/02*** | (2006.01) |
| ***F21S 10/02*** | (2006.01) |
| ***F21S 8/04*** | (2006.01) |
| ***G09F 13/02*** | (2006.01) |
| *F21W 131/405* | (2006.01) |
| *F21Y 115/10* | (2016.01) |
| *F21Y 113/13* | (2016.01) |

(52) U.S. Cl.
CPC ..... *F21V 14/02* (2013.01); *G09F 13/02* (2013.01); *F21W 2131/405* (2013.01); *F21Y 2113/13* (2016.08); *F21Y 2115/10* (2016.08)

(56) References Cited

U.S. PATENT DOCUMENTS

| | | | | |
|---|---|---|---|---|
| 6,513,949 | B1 | 2/2003 | Marshall et al. | |
| 6,692,136 | B2 | 2/2004 | Marshall et al. | |
| 6,808,806 | B2 | 10/2004 | Phillips et al. | |
| 7,064,498 | B2 | 6/2006 | Dowling et al. | |
| 7,515,128 | B2 | 4/2009 | Dowling | |
| 7,572,028 | B2 | 8/2009 | Mueller et al. | |
| 7,729,026 | B2 | 6/2010 | Argoitia et al. | |
| 7,959,320 | B2 | 6/2011 | Mueller et al. | |
| 8,378,574 | B2 | 2/2013 | Schlangen et al. | |
| 2003/0211288 | A1 | 11/2003 | Schottland | |
| 2005/0008830 | A1 | 1/2005 | Larson et al. | |
| 2007/0031777 | A1 | 2/2007 | Wang et al. | |
| 2009/0323334 | A1 | 12/2009 | Roberts et al. | |
| 2011/0133672 | A1* | 6/2011 | Tsang | F21S 10/02 315/294 |
| 2012/0052762 | A1 | 3/2012 | Heller et al. | |
| 2012/0091917 | A1* | 4/2012 | Vinther | F21S 10/023 315/312 |
| 2012/0155078 | A1* | 6/2012 | Ashdown | F21S 8/06 362/235 |
| 2012/0293992 | A1 | 11/2012 | Klaffenbach | |

FOREIGN PATENT DOCUMENTS

| | | | |
|---|---|---|---|
| GB | 978417 | A | 12/1964 |
| WO | 2009109890 | A1 | 9/2009 |
| WO | 2011131197 | A1 | 10/2011 |
| WO | 2015140131 | A1 | 9/2015 |

* cited by examiner (a)

(b)

(c)

(a) (b)

ARRANGEMENT FOR CHANGING THE VISUAL APPEARANCE OF A TARGET OBJECT

CROSS-REFERENCE TO PRIOR APPLICATIONS

This application is the U.S. National Phase application under 35 U.S.C. §371 of International Application No. PCT/EP2014/057014, filed on Apr. 8, 2014, which claims the benefit of European Patent Application No. 13162860.4, filed on Apr. 9, 2013. These applications are hereby incorporated by reference herein.

FIELD OF THE INVENTION

The invention relates to an arrangement comprising a lighting system and a target object, wherein the lighting system is arranged to illuminate the target object and to change the visual appearance thereof, preferably in a dynamical way. Such an arrangement can for example be used in a retail environment to draw attention to certain products. The invention also relates to a lighting device for use in the lighting system of the arrangement.

BACKGROUND OF THE INVENTION

In many situations it is desired to be able to change the visual appearance of an object, sometimes even in a dynamical way. For example, a retailer wants to attract a customer's attention to a product to improve the sales of the product, and such attention is typically attracted by the visual appearance of the product, by using stickers, labels, posters and other promotional material. In supermarkets, placing products on the head of gondolas or in temporary displays in the main route can give a large increase in conversion. Compelling customers to go from the main path into an aisle is something a retailer pays a lot of attention to when placing products or planning promotions. For example, labels with special promotions are put on the front of the shelves, or pop-out banners or wobblers are hung from the shelf.

Also, in a home or office environment one may want to be able to change the visual appearance of for example a wall in order to create a certain atmosphere.

The visual appearance of an object can be changed, for example, by projecting an image onto the object's surface with a projection system. A drawback of this approach is that a projection system is relatively expensive and installing such a system is relatively difficult as corrections have to be made for projecting images under an angle or on a curved target surface.

The visual appearance of an object can also be changed by illumination with a light source to induce an optical response in at least a part of the object's surface. An "optical response" refers to a change of color due to the absorption of incident light. Absorption of light can for example be used to excite a photoluminescent compound, or to reversibly transform a compound between two forms having different absorption spectra. In these cases, the optical response is referred to as "photoluminescence" and "photochromism", respectively.

In an example of photoluminescence as optical response, the surface may comprise a photoluminescent material that is applied in a certain graphical representation, so that under illumination with a suitable light source the photoluminescent material is photoexcited and starts to emit light thereby making the graphical representation visible. US-2005/0008830 discloses an article having a photoluminescent graphic disposed on an area of the article's outer cover. Upon exposure of the photoluminescent graphic to excitation light, the graphic becomes visible, for example in low-light conditions and/or after removal of the excitation light (glow-in-the-dark effect).

US-2003/0211288 discloses a plastic article wherein a photoluminescent material is incorporated into the plastic material from which the article is formed. Ambient light entering the body of the plastic article can excite the photoluminescent material, and the light that is emitted by the photoluminescent material can exit the article at locations defined by cuts and/or protrusions defining a graphic image.

For optical responses such as mentioned above, illumination with a light source may not only make a graphical representation visible, but could also change the visual appearance of any remaining part of the object's surface, and likely also of any other surface close to the object and/or in the output beam of the light source. For example, if the photoluminescent material is a phosphor that can be excited with ultraviolet light, illumination with an ultraviolet light source will also induce photoluminescence of optical whiteners in clothing of people standing close to the product and/or in the output beam of the ultraviolet light source. Furthermore, ultraviolet light sources typically also provide output in the blue part of the visible spectrum. The presence of such a visible component in the output of the ultraviolet light source will result in an undesired change of visual appearance of the illuminated object, particularly if one only wants to visualize the graphical representation defined by the photoluminescent material, without changing the appearance of any other part of the object.

It is an object of the invention to provide a solution for changing the visual appearance of at least part of an object, preferably in a dynamical way, while reducing at least some of the aforementioned drawbacks.

SUMMARY OF THE INVENTION

In a first aspect of the invention, the object is achieved by an arrangement comprising a lighting system and a target object.

The lighting system can be represented by a single lighting device having one or more light sources, or by a plurality of separate lighting devices. The lighting system is arranged to illuminate a target surface of the target object with a primary light output having a primary illumination spectrum representing a first color, and with a secondary light output having a secondary illumination spectrum representing a second color. The primary and secondary illumination spectra have different spectral power distributions, while the first and second colors have a color difference that is equal to or lower than a predetermined threshold ($\Delta E_T$) that is the lower of 20 and the outcome of the following equation:

$$\Delta E_T = \Delta E_0 + \alpha \Delta t \quad (1)$$

In Equation (1), $\Delta E_0$ is equal to, but preferably lower than 8, and $\alpha$ is equal to, but preferably lower than 8 per second. In Equation (1), $\Delta t$ represents the shortest time (in seconds) it takes an arbitrary area on the target surface from being illuminated with only one of the primary and secondary light outputs to being illuminated with only the other of the primary and secondary light outputs. Equation (1) will be further explained hereinafter.

The target surface of the target object comprises first and second target surface areas.

In the arrangement of the invention, the first and second target surface areas have a first contrast upon illumination with the primary illumination spectrum, and a second contrast upon illumination with the secondary illumination spectrum, wherein the second contrast is larger than the first contrast.

In the context of the present invention, the term "spectral power distribution" refers to the power of electromagnetic radiation at each wavelength in the electromagnetic spectrum. The spectral power distribution of the light output of a lighting device is also referred to as the "illumination spectrum". Electromagnetic radiation that is visible to the human eye has a wavelength in the range of about 380 nanometers to about 740 nanometers, a range which is referred to as the "visible spectrum". It is noted that the illumination spectrum of a lighting device can include electromagnetic radiation from the visible spectrum, as well as (near) ultraviolet and or (near) infrared radiation.

In the context of the present invention, the term "contrast" refers to the difference in color of the first and second target surface areas.

The color represented by an illumination spectrum of a light output refers to the color that is perceived when that light output is incident on the cone cells of a human eye, and this color can be determined by multiplying the illumination spectrum with the spectral responsivity curves of the cone cells.

Cone cells are a type of photoreceptors that are present in the human eye. The cone cells are for high-brightness color vision, and they exist in three types: a first type of cone cell (type S) is sensitive for light in the short-wavelength range of the visible spectrum (about 400 nm to about 500 nm), a second type of cone cell (type M) is sensitive for light in the middle-wavelength range of the visible spectrum (about 450 nm to about 630 nm), and a third type of cone cell (type L) is sensitive for light in the long-wavelength range of the visible spectrum (about 500 nm to about 700 nm). Next to cone cells, the human eye contains photoreceptors in the form of rod cells. The rod cells are for low-brightness, monochromatic vision, and they are most sensitive for light with a wavelength range of around 498 nm.

When light of a certain spectral power distribution is incident on the human eye, the extent to which the three types of rod cells are stimulated determines the perceived color (or color sensation). Three parameters known as "tristimulus values", corresponding to levels of stimulus to the three types of cone cell, can in principle describe any color sensation. A color space maps a range of physically produced spectral power distributions to actual color sensations registered in the human eye and represented by tristimulus values. Color-matching functions associate a physically-produced spectral power distribution with specific tristimulus values.

The perceived color of an object that is illuminated with a lighting device is determined by the output of the lighting device as characterized by the illumination spectrum, by the wavelength-dependent reflectivity of the object's surface as characterized by the reflectance spectrum, and by the photoluminescence of the object if any. When looking at the object, the light that is incident on the observer's eye has a spectral power distribution that is the product of the illumination and reflectance spectra, plus the photoluminescence spectrum in case the object can be photoexcited with light that is present in the illumination spectrum. Two different spectral power distributions may appear to have the same apparent color to an observer when they produce the same tristimulus values.

In the context of the present invention, the term "color" refers to a point in the CIE 1976 (L*a*b*) color space, wherein dimension L* relates to lightness, reflecting the subjective brightness perception of a color for humans along a lightness-darkness axis, and dimensions a* and b* relate to chromaticity.

In order to compute the L*a*b* values of a certain color, a reference white point is required. In the context of the present invention, the CIE 1931 XYZ values of the spectral power distribution of light reflected of an ideal white diffuser illuminated with the primary light output are used for this purpose. The difference between two colors is represented by ΔE. For two colors in the L*a*b* color space, ΔE is given by:

$$\Delta E=\sqrt{(L_2^*-L_1^*)^2+(a_2^*-a_1^*)^2+(b_2^*-b_1^*)^2} \quad (2)$$

Two colors are considered to be substantially the same if the color difference ΔE is equal to or lower than a predetermined threshold ($\Delta E_T$). The inventors have realized that in case the two colors are provided time-sequentially the predetermined threshold depends on the speed of switching between the two colors: the faster the switching speed is, the lower the predetermined threshold will be. This is expressed by Equation (1), wherein the switching speed is represented by the time it takes to change from one color to the other (Δt). The faster one color is replaced by the other, the smaller Δt will be. In the limit of infinitely high switching speeds, Δt will approach zero. In case no color is replaced by another color, and the two colors that are to be compared are present simultaneously, Δt is taken to be zero. In the aforementioned situations, wherein Δt is equal to (or approaches) zero, the value of the predetermined threshold $\Delta E_T$ is represented by $\Delta E_0$. For situations wherein a color is gradually replaced by another color, the predetermined threshold $\Delta E_T$ increases with increasing Δt, at a rate that is represented by the parameters. According to the invention, the upper limit of the predetermined threshold $\Delta E_T$ is set at a value of 20.

In Equation (1), Δt represents the shortest time (in seconds) it takes the illumination of an arbitrary area on the target surface of the target object to change between the primary light output and the secondary light output. In order to determine the value of Δt one has to find the area on the target surface that is illuminated with one of the primary and the secondary light outputs, and that has the shortest time of changing to being illuminated with the other of the primary and secondary light outputs. One is free to choose the area of the target surface (hence the term "arbitrary area") as long as this area has the shortest time of changing between illumination with the primary and secondary light outputs.

In some situations, no area can be found that changes from being illuminated between the primary and the secondary light outputs, for example because these two light outputs are both continuously present and both constantly illuminate a part of the target surface that does not change in time. If this is the case, Δt should be set equal to zero.

The inventors have found out that when the predetermined threshold $\Delta E_T$ has a value that is the lower of 20 and the outcome of Equation (1), the color difference between the first and second colors is subtle for all colors. Consequently, with the arrangement of the invention unwanted changes in the visual appearance of the target object are prevented, or at least significantly reduced. This is because the first and second colors, represented by the primary and secondary illumination spectra of the primary and secondary light outputs, are substantially the same. This means that when a person would look directly at the primary and secondary light outputs provided by the lighting system, he will perceive substantially the same color point and brightness for both outputs, so that when the lighting system would switch between the two light outputs such switching will not be noticed, or will at least not be disturbing.

It is noted that in most of the practical situations wherein the present invention can be used, it will be preferred that the first and second colors of the primary and secondary illumination spectra, respectively, are white colors, such as white colors having a correlated color temperature in a range between 2700 K and 6500 K. This has the advantage that a white surface will have a similar white appearance when illuminated with the primary and secondary light output, while the appearance of a colored surface will depend on whether it is illuminated with the primary or secondary light output.

The first and second light outputs have a different spectral power distribution, so that they can be used to change the contrast between the first and second target surface areas, but because they represent substantially the same color any unwanted contrast changes are prevented, or at least significantly reduced.

When $\Delta E_0$ is equal to 5, and $\alpha$ is equal to 6 per second, the color difference between the first and second colors is subtle for almost all colors, particularly for non-blue colors.

When $\Delta E_0$ is equal to 3, and $\alpha$ is equal to 1 per second, the color difference between the first and second colors is even more subtle, and practically invisible, for all colors.

When $\Delta E_0$ is equal to 1, and $\alpha$ is equal to 0.5 per second, the color difference between the first and second colors is invisible for almost all colors, particularly for non-blue colors.

In an embodiment of the arrangement of the invention, upon illumination with the primary light output, the first target surface area has a primary first color and the second target surface area has a primary second color, and upon illumination with the secondary light output, the first target surface area has a secondary first color and the second target surface area has a secondary second color, wherein the primary first and second colors, and the secondary first color are substantially the same but different from the secondary second color.

In this embodiment, the first and second target surface areas have substantially the same appearance under illumination with the primary light output, but a different appearance under illumination with the secondary light output. Furthermore, only the appearance of the second target surface area is different dependent on the light output; that of the first target surface area remains the same. This embodiment is advantageous because upon illumination only a graphical representation can be made visible on a surface, while the visual appearance of any remaining part of the surface remains unchanged.

In an embodiment of the arrangement of the invention, upon illumination with the primary light output, the first target surface area has a primary first color and the second target surface area has a primary second color, and upon illumination with the secondary light output, the first target surface area has a secondary first color and the second target surface area has a secondary second color, the primary and secondary first colors being substantially the same but different from the primary and secondary second colors.

In this embodiment, the first and second target surface areas always have a different color, and dependent on the light output the contrast between the two target surface areas can be changed. In other words, with the secondary light output the second target surface area can be highlighted.

In a first example of the above embodiment, the first and second target surface areas have first and second reflectance spectra, respectively. In this embodiment, the product of the primary illumination spectrum and the first reflectance spectrum, the product of the primary illumination spectrum and the second reflectance spectrum, and the product of the secondary illumination spectrum and the first reflectance spectrum have substantially the same spectral power distribution.

In the context of the present invention, the term "reflectance spectrum" refers to the plot of the reflectance as a function of wavelength, wherein the term "reflectance" refers to the fraction of incident electromagnetic power that is reflected at an interface.

In a second example of the above embodiment, the second target surface area comprises a photoluminescent material that can be excited with light that is present in one of the primary and secondary illumination spectra.

In a third example of the above embodiment, the second target surface area comprises a photochromic material that has a primary reflectance spectrum when illuminated with the primary light output and a secondary reflectance spectrum when illuminated with the secondary light output, the secondary reflectance spectrum being different from the primary reflectance spectrum. In this third example, the first and second target surface areas may have a uniform base color, with the second surface area comprising an ultraviolet-responsive photochromic material that is either transparent or that has a color that matches the base color in one of its photochromic states. When the secondary illumination spectrum comprises ultraviolet radiation the photochromic material changes color and the appearance of the second target surface area changes. Alternatively, the photochromic material may also be responsive to light of other wavelengths, for instance deep blue light with a wavelength of about 405 nm, which is poorly visible. When using a photochromic material, a colored state may remain for some time after the activating illumination has been removed, an effect that can be exploited by only briefly pulsing the activating illumination.

In an embodiment of the arrangement of the invention, the first and second target surface areas have metameric colors, and the second contrast is larger than the first contrast due to metameric failure, which can be strong when one of the first and second target surface areas has a reflectance spectrum with a distinct peak at a wavelength that is enhanced or reduced in one of the primary and secondary illumination spectra.

When under certain illumination conditions two objects with different reflectance spectra appear to have the same apparent color, these colors are called "metamers". When under different illumination conditions the same two objects appear to have different apparent colors it is called "metameric failure". For example, two pieces of black clothing may appear to have the same color in the shop, but can look quite different when outside in the sunlight.

In the arrangement according to the invention, the primary and secondary light outputs can be provided subsequently or simultaneously. When the primary and secondary light outputs are provided subsequently, some cross fading between the two light outputs may be used. It would also be possible to continuously provide the first light output while the second light output is provided intermittently.

In the arrangement according to the invention, the primary and secondary light outputs may be arranged to illuminate the same part of the target surface, or they may be arranged to illuminate different parts of the target surface. The illuminated part of the target surface may be stationary over time, or it may change over time. When the primary and secondary light outputs are each present continuously, and when each of the primary and secondary light outputs illuminates an area that does not change over time, the arrangement is referred to as a static arrangement. When at least one of the primary and secondary light outputs is not present continuously, and/or when at least one of the primary and secondary light outputs illuminates an area that changes over time, the arrangement is referred to as a dynamic arrangement.

Changing the illuminated part of the target surface can be done by redirecting a lighting device. Alternatively, the lighting device may comprise a plurality of light sources that are for example arranged in a row, and by sequentially switching the light sources on and off, the part of the target surface that is illuminated by the light output of this lighting device will change over time.

In the arrangement according to the invention, the lighting system may be arranged to illuminate the second target surface area with a time-varying secondary light output. In this case, the second target surface area receives a secondary light output from the lighting system that is not constant over time, so that the visual appearance of the second target surface area can be made to change dynamically.

The arrangement of the invention can be applied in a large variety of environments, for example in a retail environment wherein the target object is either a good or a sign in the retail environment. When applied in a retail environment, the arrangement of the invention can be used to better attract the attention of customers for the goods that are for sale, for example by dynamically changing the appearance of the good itself, or by dynamically changing the appearance of a sign that refers to the good. The arrangement of the invention can also be applied in any environment for changing the visual appearance of walls and/or ceilings in for example offices, homes and shops. In such an application the arrangement of the invention can be used to create a certain atmosphere.

The arrangement of the invention can also be applied in a traffic sign application. In such an application the lighting system may be part of a vehicle (for example, it may be comprised in a car's head light) or part of an outdoor lighting system (for example, it may be comprised in a street light), while the target object may be a traffic sign.

In a second aspect of the invention, the object is achieved by a lighting device that is arranged to provide a primary light output having a primary illumination spectrum representing a first color, and a secondary light output having a secondary illumination spectrum representing a second color. The primary and secondary illumination spectra have different spectral power distributions, while the first and second colors have a color difference that is equal to or lower than a predetermined threshold ($\Delta E_T$) that is the lower of 20 and the outcome of Equation (1), so that the first and second colors are substantially the same, as already described hereinbefore in relation to the arrangement of the invention.

Such a lighting device can be used in the arrangement according to the first aspect of the invention.

In an embodiment of the lighting device of the invention, the lighting device is arranged to be operated in a first mode for providing the first light output and in a second mode for providing the second light output. In this embodiment the lighting device further comprises a switching controller for switching between the first and second modes.

In this embodiment, the frequency of switching between the first and second modes is dependent on the application. For example, the frequency can be 80 Herz or lower so that the switching can actually be noticed by humans. For certain applications in the field of scene setting or atmosphere creation the switching frequency can be chosen to match the human circadian rhythm. The switching frequency can be constant over time, but it may also vary over time.

In an embodiment of the lighting device of the invention, the first and second light outputs are directed into different directions when the lighting device is in operation. In this embodiment, the lighting device may further comprise a directionality controller for dynamically changing the directions of the first and second light outputs.

The switching controller and the directionality controller may be integrated into a single controller unit.

In an embodiment of the lighting device of the invention, the primary illumination spectrum only contains light with wavelengths in the visible part of the electromagnetic spectrum, and the secondary illumination spectrum additionally comprises light with wavelengths in the ultraviolet and/or infrared part of the electromagnetic spectrum.

In the above embodiment of the lighting device it is preferred to use ultraviolet radiation with wavelengths longer than 315 nanometers (also known as UV-A radiation) so that people will not be exposed to UV-B and UV-C radiation. Furthermore, it is advantageous to use an ultraviolet light source based on LEDs because such a light source can be switched on and off more rapidly than other ultraviolet light sources such as those based on fluorescent tubes.

In the lighting device of the invention, the primary light output may be provided by a first light source, and the secondary light output by a second light source. For example, the first light source may comprise an RGB-LED for emitting white light while the second light source comprises a blue LED in combination with a (remote) phosphor for emitting white light, wherein both light sources are arranged to emit white light of substantially the same color temperature.

In the lighting device of the invention, the primary light output may have a primary illumination spectrum that comprises in at least a part of the visible spectrum a relatively broad emission band having a full width at half maximum (FWHM) of more than 50 nm, preferably more than 80 nm (for example an emission band representing a color chosen from the group of white, lime, amber, and red, wherein the emission band is indirectly produced by a phosphor-converted LED), while the secondary light output has a secondary illumination spectrum that comprises a relatively narrow emission band having a FWHM of less than 50 nm, preferably less than 35 nm (for example an emission band representing a color chosen from the group of primary colors red, green and blue, wherein the emission band is directly produced by an LED).

Alternatively, the first and second light outputs may be provided by the same light source, which would then have a light output that can be "programmed", for example by using a combination of multiple LEDs each emitting at different peak wavelengths. By controlling the LEDs individually, the light output can be synthesized. If needed, the reduction of one or more wavelengths in the spectrum can be visually compensated by increasing one or more other wavelengths in the spectrum.

It would also be possible to use color filters to selectively remove part of the light that is emitted by a light source, for example with a band-stop filter having a narrow stopband (also called a notch filter). Additional colored light can be used to visually compensate for the part that has been removed.

In an embodiment of the lighting device according to the invention, the first light output is provided by a first light source, and the second light output is provided by a second light source or by a combination of the first light source and the second light source. Alternatively, the first and second light outputs may also be provided by the same light source.

The lighting device according to the invention may be used to illuminate a target surface and to display a graphical representation on the target surface. For this purpose, the target surface comprises a light-responsive material arranged to provide a first optical response upon illumination with the first light output, and a second optical response upon illumination with the second light output, wherein the first optical response is different from the second optical response.

BRIEF DESCRIPTION OF THE DRAWINGS

Examples of the invention will now be described in detail with reference to the accompanying drawings, in which.

It should be noted that these figures are diagrammatic and not drawn to scale. For the sake of clarity and convenience, relative dimensions and proportions of parts of these figures have been shown exaggerated or reduced in size.

DETAILED DESCRIPTION OF THE EMBODIMENTS

Figure 1:
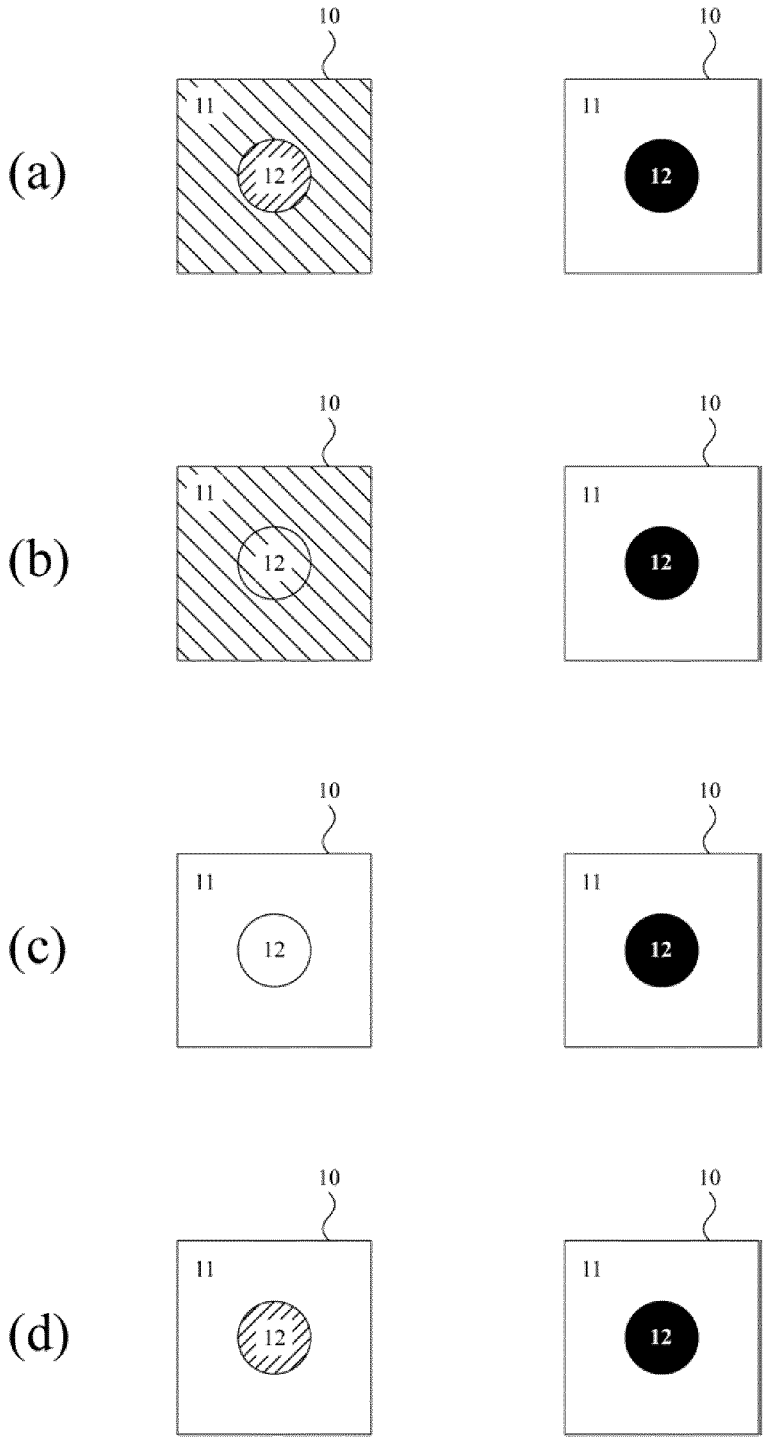
FIGS. 1*a* to 1*d* schematically show different situations of a target surface under illumination with primary and secondary light outputs, according to embodiments of the arrangement of the invention.

FIG. 1 schematically shows different situations of a target surface 10, having a first target surface area 11 and a second target surface area 12, under illumination with primary and secondary light outputs, respectively. In FIG. 1, the target surface 10 under illumination with the primary light output is shown on the left-hand side, and the target surface 10 under illumination with the secondary light output is shown on the right-hand side. For any illumination, the first and second target surface areas 11 and 12 have a contrast, and under illumination with the secondary light output (right-hand side) the contrast is larger than under illumination with the primary light output (left-hand side).

In FIG. 1*a*, the first and second target surface areas 11 and 12 have a different color under illumination with the primary light output as well as under illumination with the secondary light output. Furthermore, the color of the first target surface area 11 is different under illumination with the primary and secondary light outputs, and also the color of the second target surface area 12 is different under illumination with the primary and secondary light outputs.

In FIG. 1*b*, the first and second target surface areas 11 and 12 have substantially the same color under illumination with the primary light output, and a color difference is only obtained upon illumination with the secondary light output.

The first target surface area 11 may have substantially the same color under illumination with the primary and secondary light outputs. Illumination with the secondary light output selectively changes the color of the second target surface area 12, while that of the first target surface area 11 remains unchanged. This is illustrated in FIGS. 1(*c*) and 1(*d*).

In FIG. 1*c*, the first and second target surface areas 11 and 12 have substantially the same color under illumination with the primary light output. In this example, the target surface areas 11 and 12 are indiscernible when illuminated with the primary light output, and the second target surface area 12 can be made visible under illumination with the secondary light output.

In FIG. 1*d*, the first and second target surface areas 11 and 12 have a different color under illumination with the primary light output, a difference that is being increased upon illumination with the secondary light output. In this example, the second target surface area 12 is always distinct from the first target surface area 11 and it is highlighted when illuminated with the secondary light output.

In FIG. 1, the different appearance of the target surface 10 under illumination with the primary light output and with the secondary light output may be caused by metamerism, photoluminescence or photochromism, or any combination of one or more of these effects.

In the case of metamerism, the first and second target surface areas 11 and 12 have metameric colors, and the contrast under illumination with the secondary light output is larger than the contrast under illumination with the primary light output due to metameric failure. Preferably one of the first and second target surface areas 11 and 12 has a reflectance spectrum with a distinct peak at a wavelength that is enhanced or reduced in one of the primary and secondary illumination spectra. If this is the case, metameric failure will be strong.

In the case of photoluminescence, the second target surface area 12 comprises a photoluminescent material. The photoluminescent material may be applied as a layer on the target object 10, or it may be incorporated into the surface of the target object 10. Preferably, the first target surface area 11 does not comprise a photoluminescent material, and only the secondary light output comprises radiation that can excite the photoluminescent material comprised in the second target surface area 12. If the first and second target surface areas 11 and 12 have a reflectance spectrum that is substantially similar, they will have substantially the same color under illumination with the primary light output. Under illumination with the secondary light output, the photoluminescent material of the second target surface area 12 is excited, and the color of the second target surface area 12 changes. Preferably, the color of the first target surface area 11 does not change when illuminated with the secondary light output.

In an example the first and second target surface areas 11 and 12 have substantially the same reflectance spectrum. Of the first and second target surfaces 11 and 12, only the second target surface area 12 comprises a photoluminescent material that can be excited with ultraviolet radiation (also called a UV phosphor). In this example the primary light output does not comprise ultraviolet radiation, so that under illumination with the primary light output the color of the first and second target surface areas 11 and 12 is only determined by reflection of light. Because the first and second target surface areas 11 and 12 have substantially the same reflectance spectrum, they will have substantially the same color. The secondary light output comprises ultraviolet light that can excite the UV phosphor comprised in the second target surface area 12. The remaining part of the secondary light output is similar to the primary light output. Under illumination with the secondary light output, only the second target surface area 12 changes color because now the UV phosphor starts to emit light. The color of the first target surface area 11 remains the same as it is still only determined by reflection of light.

In the above example, ultraviolet radiation is used to excite a photoluminescent material comprised in the second target surface area 12. When using ultraviolet radiation in the arrangement of the invention for applications where people can be exposed to this radiation, it is preferred to use ultraviolet radiation with wavelengths longer than 315 nanometers (also known as UV-A radiation) so that people will not be exposed to UV-B and UV-C radiation. Furthermore, when using ultraviolet radiation in the arrangement of the invention it is advantageous to use an ultraviolet light source based on LEDs because such a light source can be switched on and off more rapidly than other ultraviolet light sources such as those based on fluorescent tubes. A further advantage of using an ultraviolet light source based on LEDs is that it has a relatively narrow spectral emission profile.

When the second target surface area 12 comprises a material that is responsive to ultraviolet radiation but that has a color that is substantially the same as that of the first target surface area 11, alignment marks that are also responsive to ultraviolet radiation are preferably used on the target object 10 when creating the first and second target surface areas 11 and 12, respectively.

Using ultraviolet radiation may induce undesired photoluminescence of optical whiteners that are present in the clothing of people standing close to the arrangement. Therefore, in a further example, such undesired effects are reduced by using photoluminescent materials that can be excited with near-ultraviolet radiation. In this further example, a first light source is used to generate the primary light output with a color point $xy_1$ in the CIE 1931 chromaticity diagram. The secondary light output is a combination of the output of the first light source with that of second and third additional light sources. The second light source is a near-ultraviolet light source with a color point $xy_B$, which typically lies close to xy=(0.17, 0). To compensate for the resulting color shift towards $xy_B$, the third light source has a color point that lies on the line connecting $xy_B$ and $xy_1$, but on the opposite side of $xy_1$ towards the yellow/amber region of the diagram. The relative intensity of this third light source is chosen such that the color point of the combination of the first, second and third light sources is considerably the same as that of $xy_1$.

Alternatively, for the secondary light output, the first and third light sources may be replaced by an alternative third light source that produces a light output that has the same color point as the light output as that of the first and third light sources combined. In this case the first light source should be switched off when the secondary light output is to be provided. As an example, the primary light output may be from a neutral-white light source (color temperature of about 4100 K) while the secondary light output is from a warm-white light source (color temperature of about 3000 K) combined with a near-ultraviolet component centered around 405 nanometers.

In the case of photochromism, the second target surface area 12 comprises a photochromic material. The photochromic material may be applied as a layer on the target object 10, or it may be incorporated into the surface of the target object 10. Preferably, the first target surface area 11 does not comprise a photochromic material, and only the secondary light output comprises radiation that can induce a photochromic color change of the photochromic material comprised in the second target surface area 12. If the first and second target surface areas 11 and 12 have a reflectance spectrum that is substantially similar, they will have substantially the same color under illumination with the primary light output. Under illumination with the secondary light output, the color of the second target surface area 12 changes. Preferably, the color of the first target surface area 11 does not change when illuminated with the secondary light output.

In an example the first and second target surface areas 11 and 12 have substantially the same reflectance spectrum. Of the first and second target surface areas 11 and 12, only the second target surface area 12 comprises a photochromic material that is responsive to ultraviolet radiation. In this example the primary light output does not comprise ultraviolet radiation, so that under illumination with the primary light output the color of the first and second target surface areas 11 and 12 is only determined by reflection of light. Because the first and second target surface areas 11 and 12 have substantially the same reflectance spectrum, they will have substantially the same color. The secondary light output comprises ultraviolet light that can induce a color change in the photochromic material comprised in the second target surface area 12. The remaining part of the secondary light output is similar to the primary light output. Under illumination with the secondary light output, only the second target surface area 12 changes color because now a color change is induced in the photochromic material. The color of the first target surface area 11 remains the same as it is still only determined by reflection of light. In this example, the photochromic material may be a material that is transparent for the primary light output. Alternatively to a photochromic material that is responsive to ultraviolet radiation, a photochromic material that is responsive to light of about 405 nm (which is poorly visible for humans) can also be used.

In FIG. 1, the different appearance of the target surface 10 under illumination with the primary light output and with the secondary light output may also be caused by having first and second target surface areas 11 and 12 with different reflectance spectra. These two different reflectance spectra are preferably chosen such that under illumination with the primary light output the first and second target surface areas 11 and 12 have the same color, while under illumination with the secondary light output they have a different color.

When the different appearance of the target surface 10 under illumination with the primary light output and with the secondary light output is caused by photoluminescence or photochromism, it is preferred to use photoluminescent or photochromic materials that are responsive for wavelengths for which the eye is less sensitive, for instance wavelengths around about 405 nm. By doing this, it is easier to selectively change the appearance of the second target surface area, and not that of the first target surface area. Furthermore, it is preferred to use photoluminescent or photochromic materials that have a reduced responsivity for light of wavelengths longer than about 450 nanometers, because such light is typically present under general lighting conditions and could induce undesired changes in the appearance of the target object.

In an example, the first and second target surface areas 11 and 12 have first and second reflectance spectra, respectively. The product of the primary illumination spectrum and the first reflectance spectrum, the product of the primary illumination spectrum and the second reflectance spectrum, and the product of the secondary illumination spectrum and the first reflectance spectrum have substantially the same spectral power distribution. The product of the secondary illumination spectrum and the second reflectance spectrum has a different spectral power distribution. This is shown schematically in the table below, wherein A and B denote different spectral power distributions.

| | First reflectance spectrum | Second reflectance spectrum |
|---|---|---|
| Primary illumination spectrum | A | A |
| Secondary illumination spectrum | A | B |

In this example, the first and second target surface areas 11 and 12 have substantially the same appearance under illumination with the primary light output, but a different appearance under illumination with the secondary light output. Furthermore, only the appearance of the second target surface area 12 is different dependent on the light output; that of the first target surface area 11 remains the same.

The arrangement of the invention can for example be used in a retail environment, wherein the target object is either a good that is for sale, or a sign such as a sticker, a price tag, or a poster. With the arrangement of the invention, the attention of a customer in the retail environment can be stronger drawn towards a certain good that is for sale, for example by dynamically displaying a message on the good itself, or on a sign that refers to the good. Such a displayed message can either by a text message, or a graphical message. Particularly when used in a retail environment, the second target surface area can be aligned with graphical elements (such as a logo, a layout, a drawing or a label) that are present on the surface of the target object. For example, referring to FIG. 1, the second target surface area 12 can be aligned with a circular drawing that is present on the target object 10.

Figure 2:
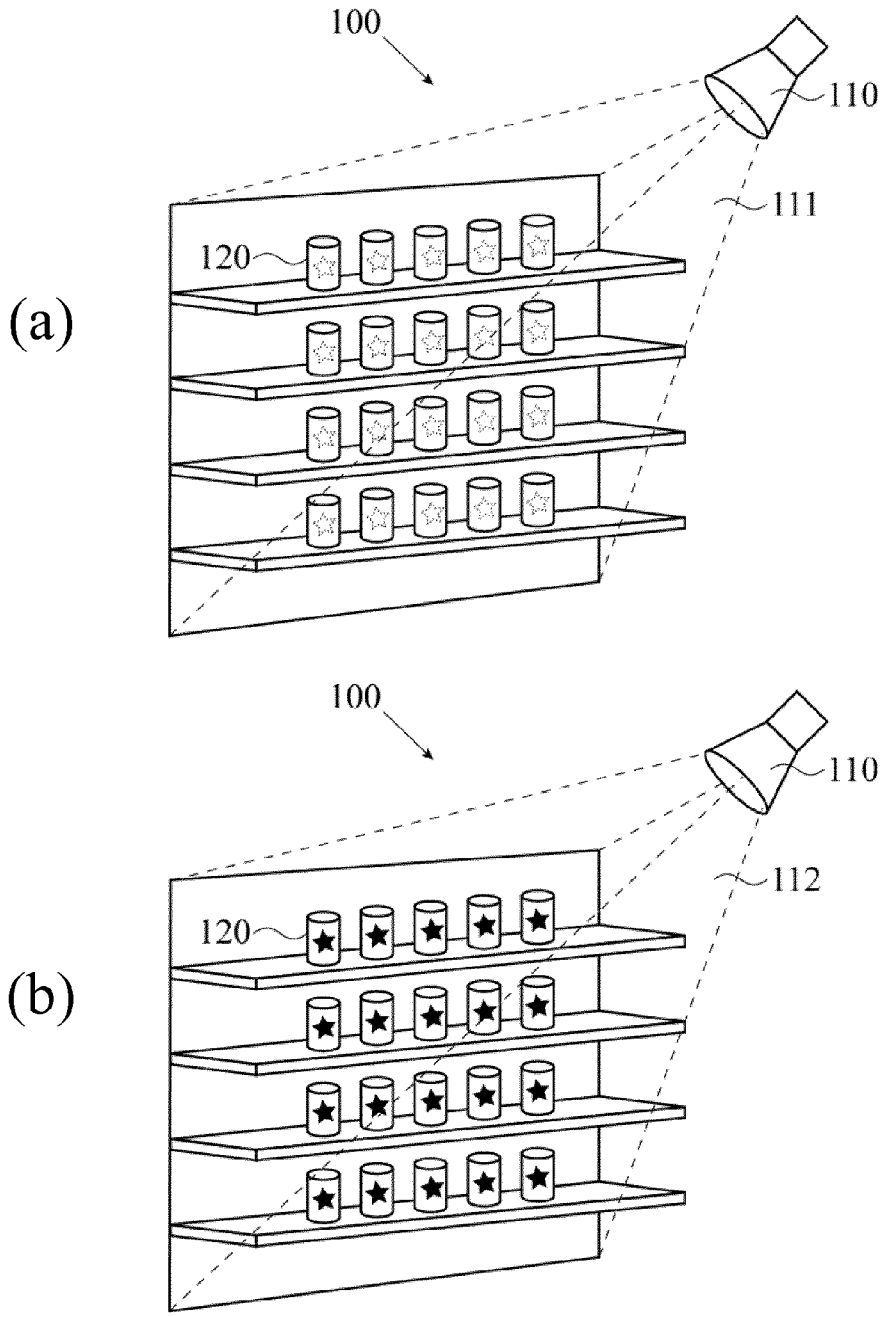
FIGS. 2*a* and 2*b* schematically show an embodiment of the arrangement of the invention.

FIG. 2 shows an embodiment of the arrangement according to the invention. The arrangement 100 comprises a lighting system 110 and a target object 120. In the embodiment of FIG. 2, the arrangement is used in a retail environment, and the target object 120 is a good that is displayed on a shelf. The lighting system 110 is arranged to illuminate the target object 120 with a primary light output 111 (FIG. 2(*a*)) and with a secondary light output 112 (FIG. 2(*b*)).

In the embodiment of FIG. 2, the lighting system 110 is configured to switch between the primary light output 111 and the secondary light output 112. The surface of the target object 120 has a star-shaped symbol on a background. The star-shaped symbol represents the second target surface area, while the surface part surrounding the star-shaped symbol represents the first target surface area (not numbered in this figure). Under illumination with the primary light output 111 (FIG. 2(*a*)), the star-shaped symbol blends in with the background, while it becomes visible under illumination with the secondary light output 112 (FIG. 2(*b*)), without a substantial change in appearance of the background.

Figure 3:
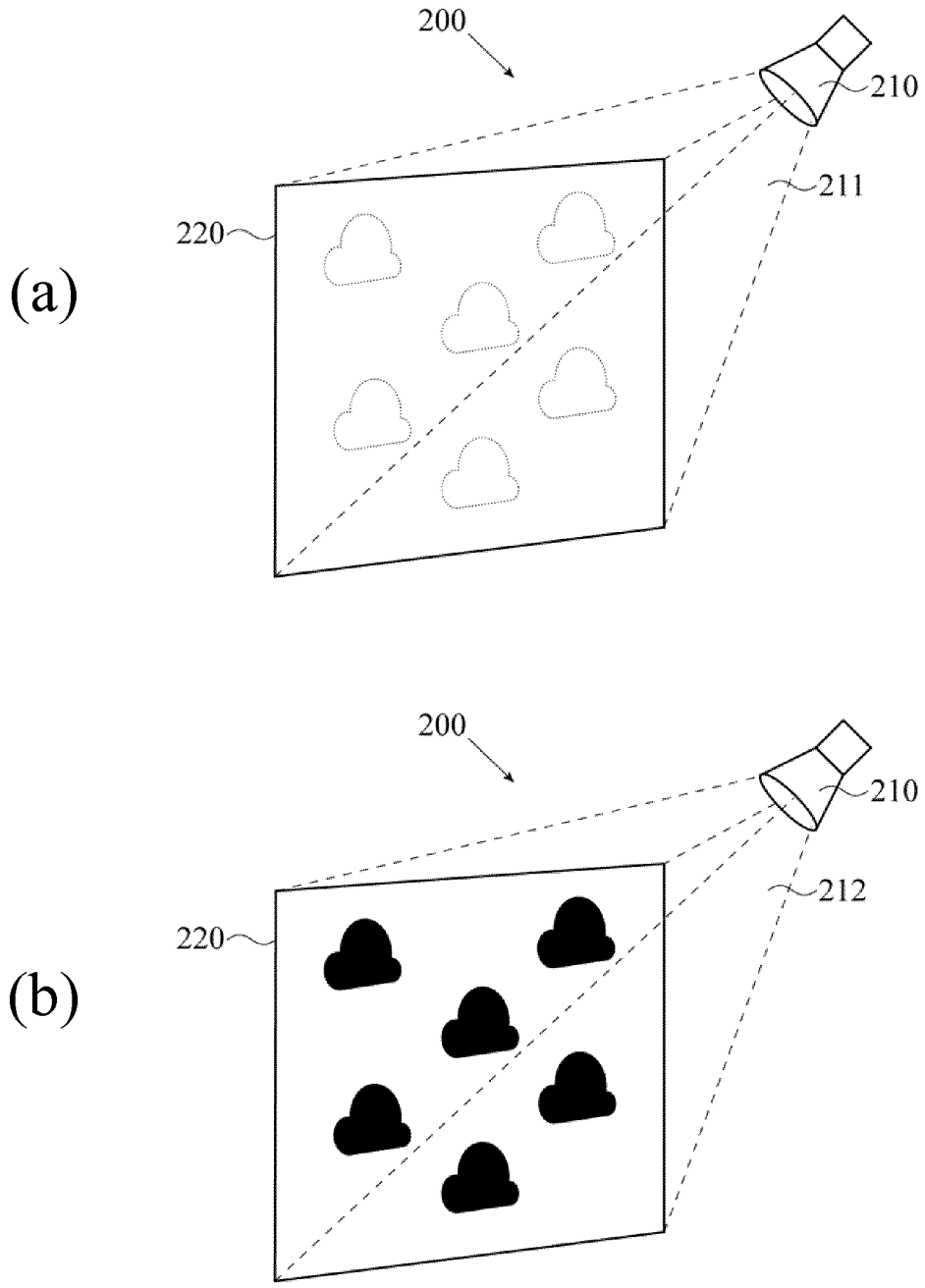
FIGS. 3*a* and 3*b* schematically show an embodiment of the arrangement of the invention.

FIG. 3 shows an embodiment of the arrangement according to the invention. The arrangement 200 comprises a lighting system 210 and a target object 220. In the embodiment of FIG. 3, the target object 220 is a wall of a room. The lighting system 210 is arranged to illuminate the target object 220 with a primary light output 211 (FIG. 3(*a*)) and with a secondary light output 212 (FIG. 3(*b*)). In this embodiment, the lighting system 210 is configured to switch between the primary light output 211 and the secondary light output 212. The surface of the target object 220 has a plurality of cloud-shaped symbols on a background. The plurality of cloud-shaped symbols represents the second target surface area, while the surface part surrounding the cloud-shaped symbols represents the first target surface area (not numbered in this figure). Under illumination with the primary light output 211 (FIG. 3(*a*)), the cloud-shaped symbols blend in with the background, while they become visible under illumination with the secondary light output 212 (FIG. 3(*b*)), without a substantial change in appearance of the background.

In the embodiments shown in FIGS. 2 and 3, the lighting systems 110 and 210 are drawn in the form of a single lighting device that is capable of providing first and second light outputs. For these embodiments it would also be possible to have lighting systems in the form of a plurality of separate lighting devices, each being able to provide a light output. For example, in the arrangement of FIG. 2, the first light output 111 can be provided by a first lighting device that is located at a ceiling in the retail environment, for example a lighting device that is also used for general illumination purposes, while the second light output 112 is a combination of the output of the first lighting device and the output of a second lighting device, wherein the second lighting device is located on or near a shelf on which the target objects 120 are displayed. The second lighting device can be battery-powered, which is particularly advantageous in case the shelf is part of a temporary promotional display.

Figure 4:
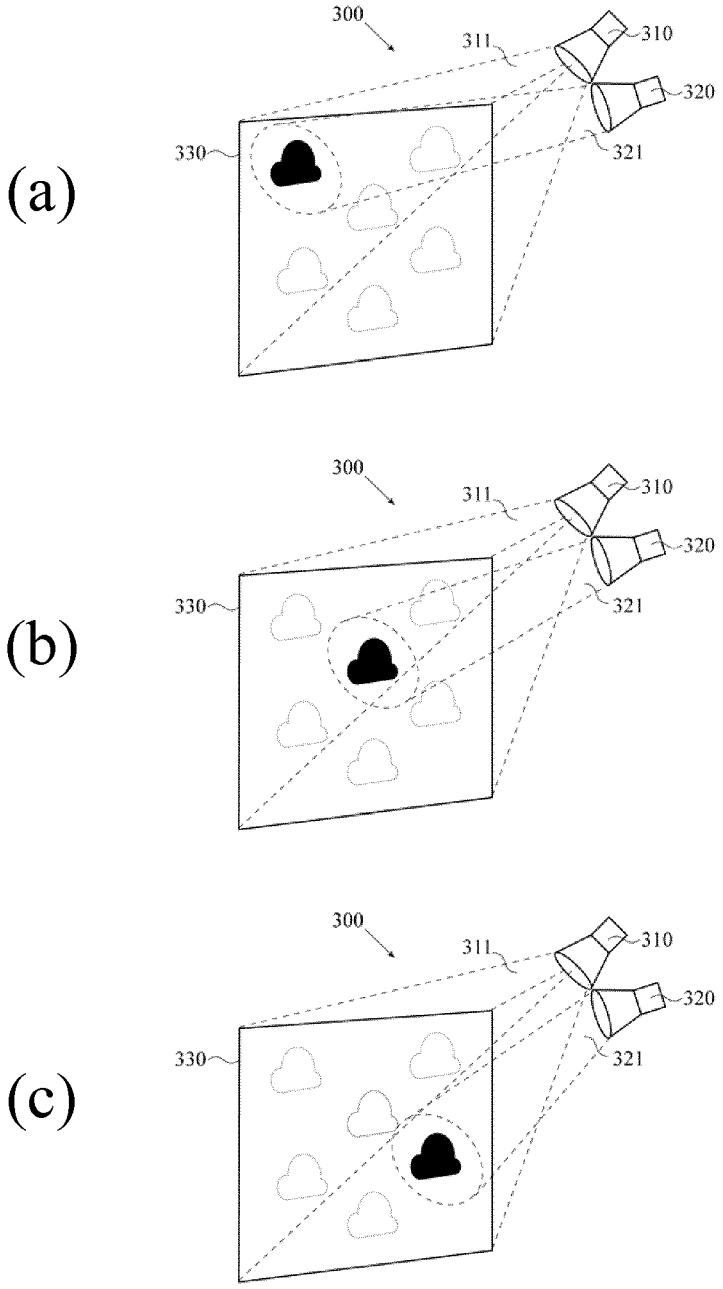
FIGS. 4*a* to 4*c* schematically show an embodiment of the arrangement of the invention.

FIG. 4 shows an embodiment of the arrangement according to the invention. The arrangement 300 comprises a lighting system having a first lighting device 310 and a second lighting device 320. The arrangement 300 also comprises a target object 330 in the form of a wall of a room.

The lighting system is arranged to illuminate the target object 330 with a primary light output and with a secondary light output. The primary light output consists only of the output 311 of the first lighting device 310, while the secondary light output consists of a superposition of the outputs 311 and 321 of the first and second lighting devices 310 and 320, respectively. The surface of the target object 330 has a plurality of cloud-shaped symbols on a background. The plurality of cloud-shaped symbols represents the second target surface area, while the surface part surrounding the cloud-shaped symbols represents the first target surface area (not numbered in this figure). In this embodiment, the lighting system is configured to provide the primary light output and the secondary light output simultaneously. The output 311 of the first lighting device 310 is for illuminating the entire target surface 330 and it is constant over time. The output 321 of the second lighting device 320 is directed at only a part of the target surface 330 and over time changes direction to illuminate different parts of the target surface 330. FIGS. 4(*a*)-(*c*) show the arrangement 300 at different moments in time. In the part of the target object 330 that is illuminated with the primary light output, the cloud-shaped symbols blend in with the background. In the part of the target object 330 that is illuminated with the secondary light output, the cloud-shaped symbols become visible, without a substantial change in appearance of the background.

Figure 5:
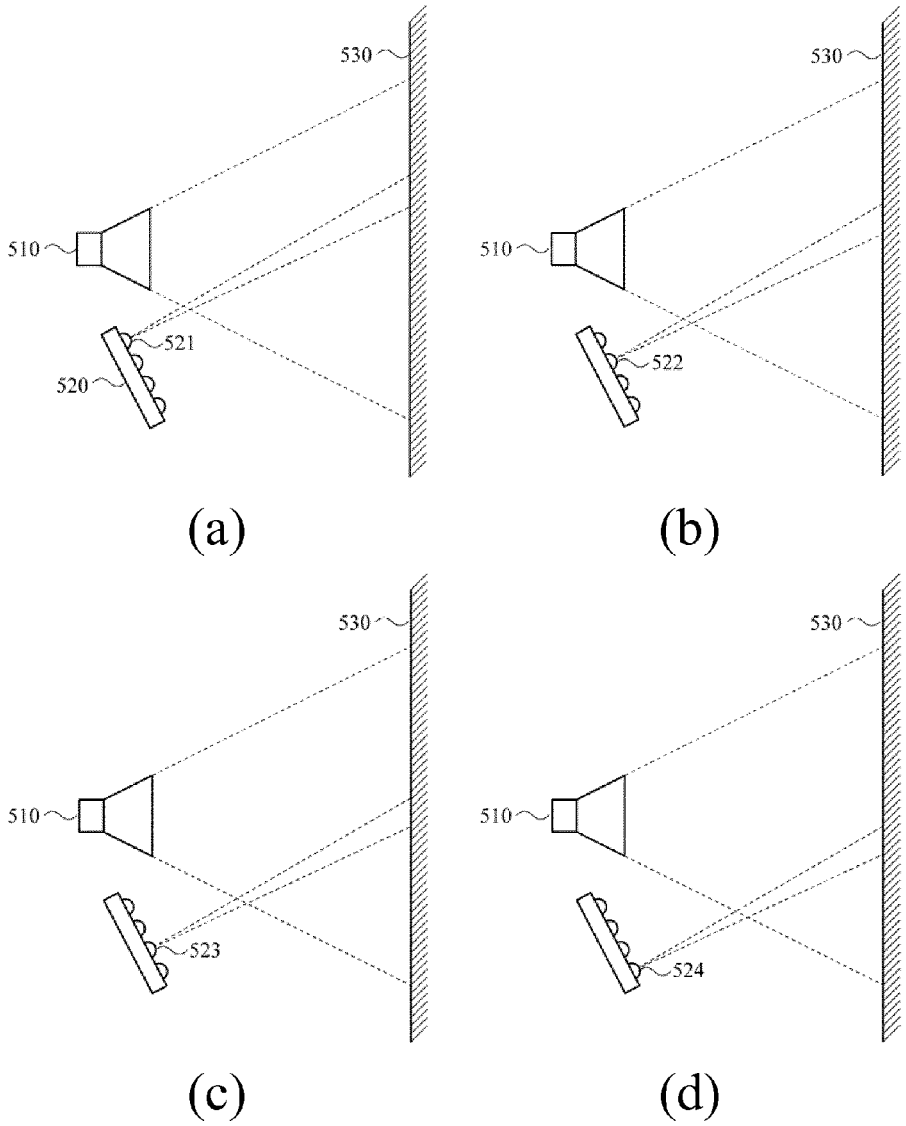
FIGS. 5*a* to 5*d* schematically show an embodiment of the arrangement of the invention.

In FIG. 4, the secondary light output changes over time to illuminate different parts of the target object 330. This is done by redirecting the output 321 of the second lighting device 320, for example by mechanically changing the orientation of the second lighting device 320. FIG. 5 illustrates an alternative way of changing the secondary light output over time to illuminate different parts of a target object. FIG. 5 shows an embodiment of the arrangement according to the invention, comprising a lighting system having a first lighting device 510 and a second lighting device 520. The second lighting device 520 comprises a plurality of light sources 521-524 arranged in a row. By sequentially switching on these light sources 521-524, the secondary light output changes over time to illuminate different parts of the target object 530, while the second lighting device 520 as a whole remains stationary.

Figure 6:
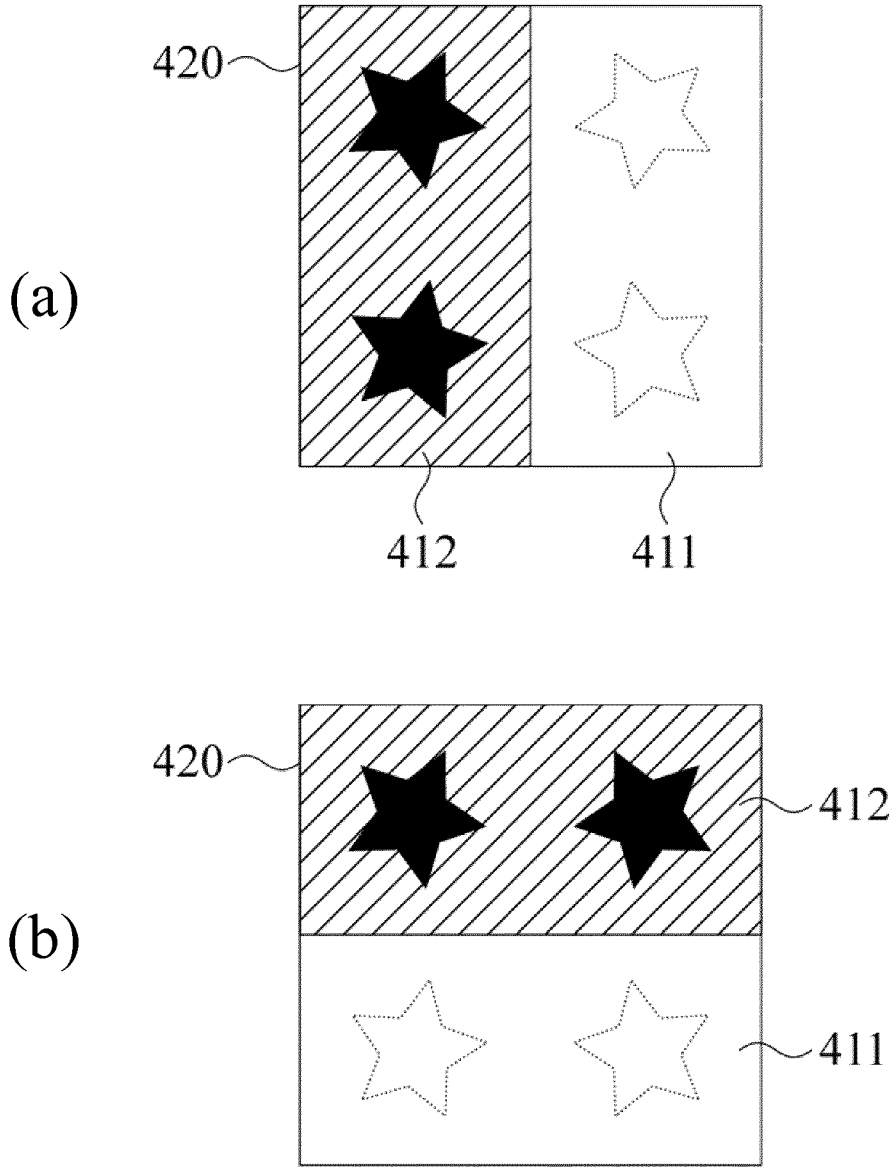
FIGS. 6*a* and 6*b* schematically show an embodiment of the arrangement of the invention.

FIG. 6 shows an embodiment of the arrangement according to the invention. For the sake of clarity, the lighting system itself is not shown in FIG. 6, but only the projection of the primary light output 411 and the secondary light output 412 on the target object 420. It is noted that in FIG. 6 the hatched part is only for indicating the part of the target object 420 that is illuminated with the secondary light output 412. It is not meant to indicate the actual visual appearance of that part. The surface of the target object 420 has a plurality of star-shaped symbols on a background. Each star-shaped symbol represents a second target surface area, while the surface part surrounding the star-shaped symbol represents the first target surface area (not numbered in this figure). Under illumination with the primary light output 411, the star-shaped symbols blend in with the background. Under illumination with the secondary light output 412, the star-shaped symbols contrast with the background and become visible. FIG. 6(*a*) shows the arrangement at a first moment in time, while FIG. 6(*b*) shows the same arrangement at another moment in time.

Figure 7:
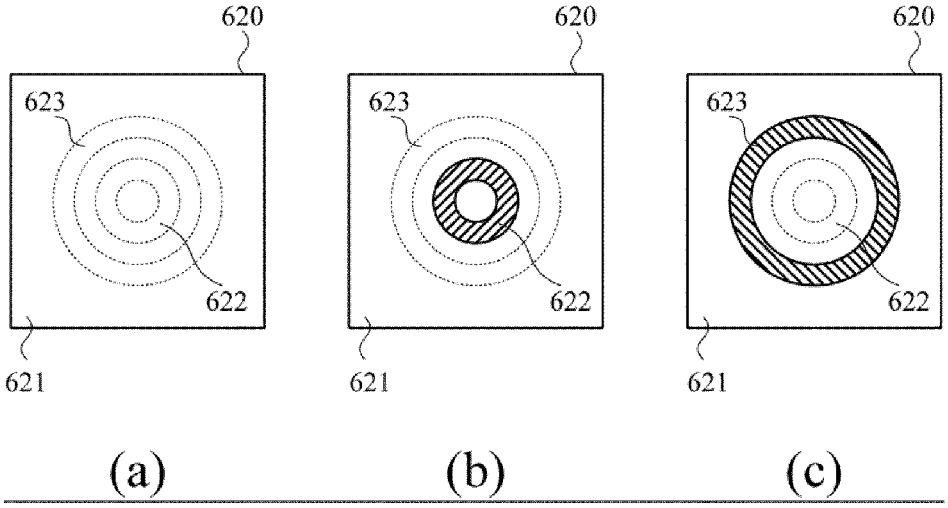
FIGS. 7*a* to 7*c* schematically show an embodiment of the arrangement of the invention.

FIG. 7 shows an embodiment of the arrangement according to the invention, wherein for the sake of clarity the lighting system itself is not shown. FIG. 7 shows a target surface 620, with a first target surface area 621, a second target surface area 622, and a third target surface area 623. The second and third target surface areas 622 and 623 have the form of concentric rings, with the first target surface area 621 representing the remaining area of the target surface. Under illumination with the primary light output (shown in FIG. 7(*a*)), the first and second target surface areas 622 and 623 blend in with the background (i.e. they have substantially the same visual appearance as the first target surface area 621. Under illumination with the secondary light output (shown in FIG. 7(*b*)), only the appearance of the second target surface area 622 changes and becomes visible. In this particular arrangement, the lighting system is arranged to illuminate the target surface 620 with a tertiary light output having a third illumination spectrum, the result of which is illustrated in FIG. 6(*c*). Under illumination with this tertiary light output, only the appearance of the third target surface area 623 changes and becomes visible. By switching between light outputs, the perception of a ring changing size can be created. Of course, any other kinds of shapes may be used in this embodiment for creating a desired animation.

Photoluminescent or photochromic materials with different spectral sensitivities may be used to create desired animations using multiple light outputs. In the embodiment illustrated in FIG. 7, the second and third target surface areas 622 and 623 may each comprise a photoluminescent material, wherein the photoluminescent materials are chosen such that each can be photoexcited with radiation that is not able to photoexcite the other, so that the secondary and tertiary light outputs can each be used to selectively photoexcite one of the photoluminescent materials. For example, the second target surface area 622 may comprise a photoluminescent material that is only responsive to shorter wavelengths while the third target surface area 623 comprises a photoluminescent material that at least also responds to longer wavelengths, so that dependent on the light output that is used to illuminate the target surface either one photoluminescent material or the other or both can be photoexcited.

Figure 8:
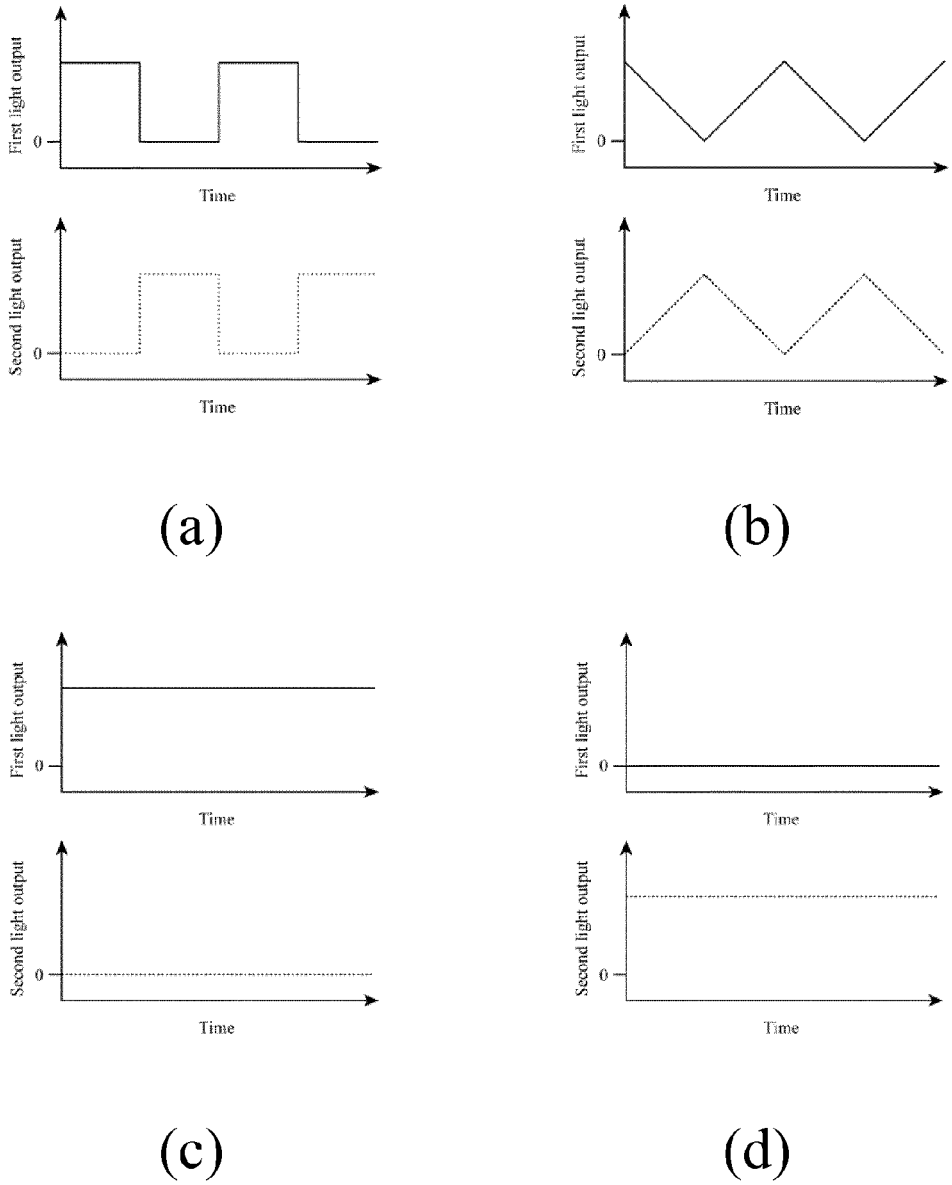
FIGS. 8*a* to 8*d* schematically show how, in the arrangement according to the invention, the primary and secondary light outputs may be provided as a function of time.

FIG. 8 shows how, in the arrangement according to the invention, the primary and secondary light outputs may be provided as a function of time to an arbitrary area of a target surface, with each light output varying between a maximum value and a minimum value. Such variation may be the result of a varying intensity of a light output, or by a change in direction of a light output. Although in FIG. 8 the minimum value is indicated with zero, it would also be possible to vary between a maximum value and a non-zero minimum value. It is also noted that the variations in light output as shown in FIG. 8 do not have to be periodic in time. The light output may also vary in a random way, and/or a light output may be provided in bursts.

In FIGS. 8*a* and 8*b*, the primary and secondary light outputs are provided subsequently, wherein in the situation of FIG. 8*b* some cross fading takes place between the primary and secondary light outputs.

In FIG. 8*a*, the shortest time it takes the arbitrary area on the target surface from being illuminated with only one of the primary and secondary light outputs to being illuminated with only the other of the primary and secondary light outputs is approximately equal to zero (the primary and secondary light outputs are each switched on and off almost instantaneously). In other words, if the arbitrary area of FIG. 8*a* is the part of the target surface that has the shortest time of changing between the primary light output and the secondary light output, FIG. 8*a* represents a situation in which $\Delta t$ approaches zero.

If the arbitrary area of FIG. 8*b* is the part of the target surface that has the shortest time of changing between the primary light output and the secondary light output, Δt is given by the time between the maximum and minimum values of either one of the primary and secondary light outputs.

In FIG. 8*c*, the arbitrary area of the target surface is continuously illuminated with only the primary light output, while in FIG. 8*d* it is continuously illuminated with only the secondary light output.

When the target surface is statically illuminated with the primary and secondary light outputs, no arbitrary target surface area exists that changes from being illuminated with only one of the primary and secondary light outputs to being illuminated with only the other of the primary and secondary light outputs. Static illumination refers to the case wherein the primary and secondary light outputs are both present continuously and are each continuously illuminating a part of the target surface that does not change over time. For the static illumination case, Δt should be set equal to zero.

When the arrangement of the present invention has to be installed in an environment, such as a retail environment, it is preferred to be able to create a realistic preview of the arrangement, particularly of the appearance of the target object when the arrangement is in operation. For this purpose one has to take into account the primary and secondary illumination spectra of the lighting system, as well as the optical characteristics of the first and second target surface areas. With respect to the latter, it is important to know the optical response of any photoluminescent or photochromic material that may be comprised in one of these second target surface areas. Parameters that should be taken into account are for example the optical response to illumination with ultraviolet radiation for photochromic and photoluminescent effects, and the ratio of the intensity of visible light to invisible light (such as ultraviolet light) to judge visibility of photoluminescence.

When using the arrangement of the invention to draw attention to certain commercial products, dynamics in the visual appearance of the product makes it possible to link the online and offline identity of a brand. Rhythms and/or dynamics in advertisements on television and on internet can be repeated by the dynamically changing visual appearance in the shop.

A lighting device for use in an arrangement as described above may comprise three or more individually-addressable LED light sources, wherein each LED light source is arranged to provide a light output having an illumination spectrum that is different from that of any of the other LED light sources. Each LED light source may either comprise a direct emitting LED (i.e. an LED whose light output is not based on phosphor conversion) or a phosphor-converted LED (i.e. an LED whose light output is based on phosphor conversion). For example, the lighting device may comprise four individually-addressable LED light sources, each for emitting one of the colors red, green, blue, white and amber. This lighting device can be operated in a first mode and in a second mode. In the first mode the lighting device can provide a primary light output having a primary illumination spectrum representing a first color, and in the second mode the lighting device can provide a secondary light output having a secondary illumination spectrum representing a second color. The first and second colors can be substantially the same, while the primary and secondary illumination spectra can be different.

The above lighting device is capable of providing a primary illumination spectrum in the form of a broad phosphor-converted spectrum representing a white color (with for example a color temperature of about 5000 K), and a secondary illumination spectrum that consists of red, green and blue components mixed in a predetermined ratio resulting in a color that is substantially equal to that of the primary illumination spectrum. Although these two illumination spectra represent substantially the same color, it is clear that compared to the primary illumination spectrum, the secondary illumination spectrum contains relatively more intensity in the red part of the spectrum.

When this lighting device is used to illuminate a target surface having a white area, an observer will see no difference in the appearance of this white area when switching between the two modes. However, when the target surface also comprises a red area (i.e. an area that is particularly reflective for light in the red part of the spectrum) the observer will see a clear change in contrast between the white area and the red area when switching between the two modes. When the white and red areas are part of the surface of a traffic sign, the lighting device can be used to better attract attention to the traffic sign.

It has been observed experimentally that good results can be obtained when in a certain spectral region the peak intensity of the secondary illumination spectrum is at least 50% higher than that of the primary illumination spectrum in the same spectral region, preferably at least a factor of two higher, and more preferably a factor of three to four higher.

It has also been observed experimentally that good results can be obtained with a lighting device wherein the illumination spectra of two modes are different in the wavelength range from about 550 nm to about 600 nm, or in the wavelength range from about 600 nm to about 640 nm, or in the wavelength range from about 640 nm to about 680 nm. The results can be optimized when the differences in these wavelength ranges amount to at least 30%, preferably at least 50%, and more preferably at least 70%.

Hereinafter, the arrangement of the invention will be further illustrated with three examples. In each of these examples a lighting device is used to illuminate a target object having a target surface that contains a first target surface area and a second target surface area. Furthermore, in each of these examples the lighting device that is used can switch between a primary light output and a secondary light output. If the lighting device switches according the pattern as illustrated in FIG. 8(*a*), the shortest time (Δt) it takes the illumination of an arbitrary area on the target surface to change between the primary light output and the secondary light output is approximately equal to zero, so that the outcome of $\Delta E_0+\alpha\Delta t$ is approximately equal to 8. In other words, if the lighting device switches according the pattern as illustrated in FIG. 8(*a*), the predetermined threshold ($\Delta E_T$) for the color difference between the primary and secondary light outputs will be constant and equal to 8. If the lighting device switches according the pattern as illustrated in FIG. 8(*b*), the predetermined threshold ($\Delta E_T$) will depend on the actual switching frequency. For switching frequencies lower than 0.33 Hz, Δt will be larger than 1.5 seconds, so that the outcome of $\Delta E_0+\alpha\Delta t$ will be larger than 20. Δt such switching frequencies the predetermined threshold ($\Delta E_T$) for the color difference between the primary and secondary light outputs will therefore be constant and equal to 20. For switching frequencies above 0.33 Hz, the predetermined threshold ($\Delta E_T$) decreases as a function of frequency. For example, when the lighting device switches between the primary and secondary light output at a frequency of 1 Hz, Δt is equal to 0.5 seconds. Under these conditions $\Delta E_0+\alpha\Delta t$ results in a value of 12, which, being lower than 20, represents the predetermined threshold ($\Delta E_T$) under these conditions. With increasing switching frequencies the value of the predetermined threshold ($\Delta E_T$) decreases, until in the limit of infinitely high switching frequencies it approaches the value of 8.

Figure 9:
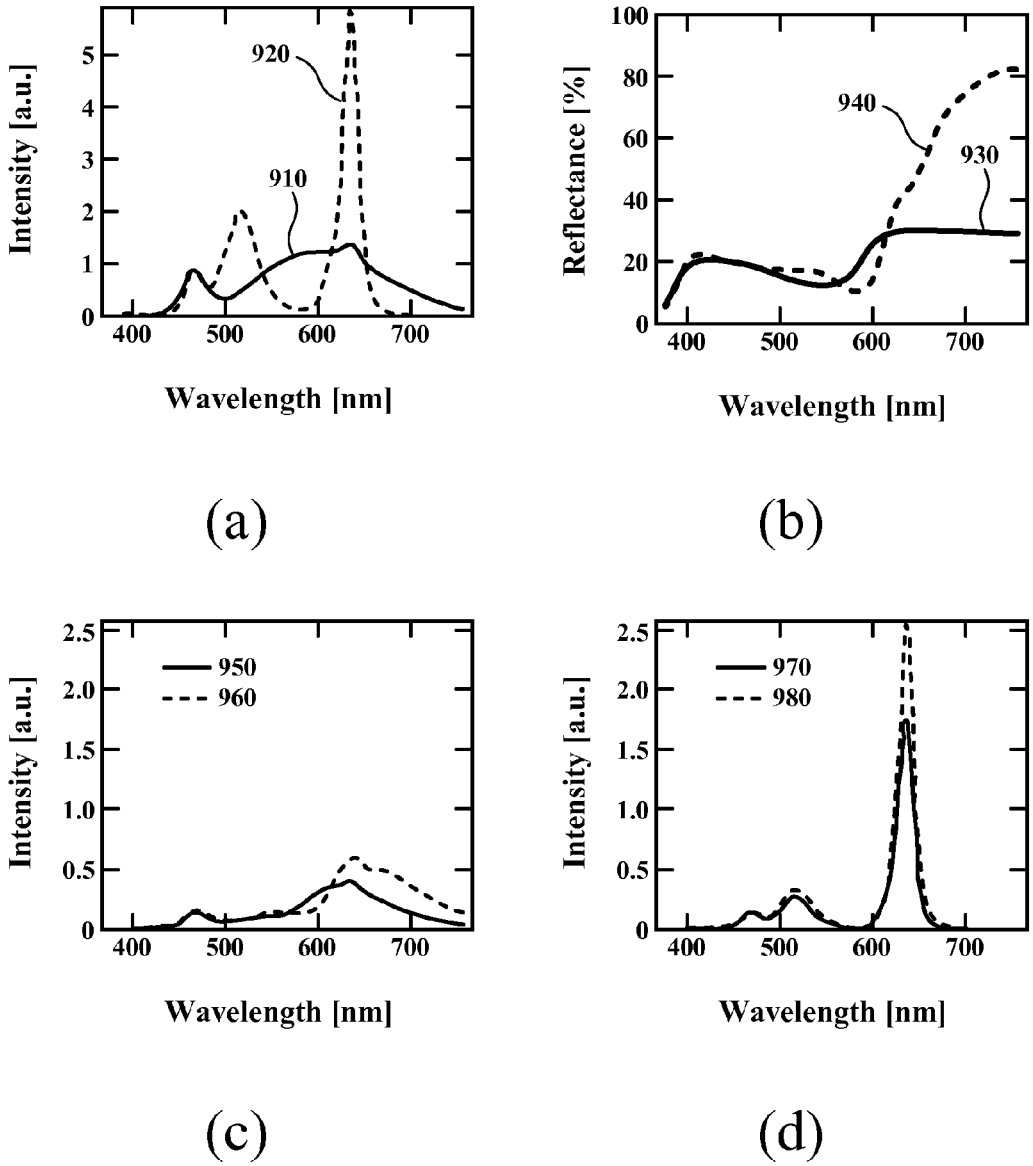
FIGS. 9*a* to 9*d* relate to a first example of an arrangement according to the invention, and show the primary and secondary illumination spectra of the primary and secondary light output, respectively (FIG. 9*a*), first and second reflectance spectra of the first and second target surface areas, respectively (FIG. 9*b*), and spectral power distributions of the light that is returned from the first and second target surface areas upon illumination with the primary and secondary light outputs (FIGS. 9*c* and 9*d*)

The first example relates to metamerism, and it is illustrated in FIG. 9. The lighting device used in this example contains LED light sources, and it is arranged to provide a primary light output having a primary illumination spectrum 910, and a secondary light output having a secondary illumination spectrum 910, as shown in FIG. 9(*a*). The primary and secondary illumination spectra 910 and 920, respectively, have been obtained by measuring with a spectroradiometer the spectral power distribution of light reflected off a white reflectance standard under both the primary and secondary light output. Using the CIE standard observer color-mapping function the CIE 1931 XYZ values of the primary and secondary illumination spectra 910 and 920 can be calculated.

| | X | Y | Z |
|---|---|---|---|
| Primary illumination spectrum 910 | 108.1 | 100.0 | 39.3 |
| Secondary illumination spectrum 920 | 108.1 | 100.0 | 39.3 |

Because the primary and secondary illumination spectra 910 and 920, respectively, have the same CIE 1931 XYZ values, their color difference ($\Delta E$) is equal to zero. This means that irrespective of the actual switching pattern, the primary and secondary light output always have a color difference that is lower than the predetermined threshold (which will be somewhere between 8 and 20).

In the first example the first target surface area has first reflectance spectrum 930 and the second target surface area has second reflectance spectrum 940, as shown in FIG. 9(*b*). When comparing the illumination spectra and the reflectance spectra, it can be seen that the primary and secondary illumination spectra 910 and 920, respectively, differ the most in the spectral region where there is also a relatively large difference between the first and second reflectance spectra 930 and 940, respectively.

Each of the first and second target surface areas can be illuminated with the primary light output and with the secondary light output. The spectral power distributions of the light that is returned from these first and second target surface areas upon such illumination can be measured with a spectroradiometer. Light that is returned from the first target surface area upon illumination with the primary light output having primary illumination spectrum 910 is measured to have spectral power distribution 950. Spectral power distribution 960 is measured for illumination of the second target surface area with the primary light output having primary illumination spectrum 910. Light that is returned from the first target surface area upon illumination with the secondary light output having secondary illumination spectrum 920 is measured to have spectral power distribution 970. Spectral power distribution 980 is measured for illumination of the second target surface area with the secondary light output having secondary illumination spectrum 920.

The spectral power distributions 950, 960, 970 and 980 are shown in FIGS. 9(*c*) and 9(*d*), and for each of them the CIE 1931 XYZ values can be calculated using the CIE standard observer color-mapping function.

| | First target surface area | | | Second target surface area | | |
|---|---|---|---|---|---|---|
| | X | Y | Z | X | Y | Z |
| Primary illumination spectrum 910 | 24.7 | 18.6 | 7.3 | 24.9 | 18.1 | 7.2 |
| Secondary illumination spectrum 920 | 29.2 | 20.0 | 7.0 | 37.4 | 34.4 | 7.1 |

From the above CIE 1931 XYZ values, points in the CIE 1976 (L*a*b*) color space can be calculated, using the CIE 1931 XYZ values of the spectral power distribution of light reflected of an ideal white diffuser illuminated with the primary illumination spectrum 910 as a reference white point.

| | First target surface area | | | Second target surface area | | |
|---|---|---|---|---|---|---|
| | $L_1$* | $a_1$* | $b_1$* | $L_2$* | $a_2$* | $b_2$* |
| Primary illumination spectrum 910 | 50.2 | 20.4 | 0.1 | 49.6 | 23.9 | −0.6 |
| Secondary illumination spectrum 920 | 51.8 | 30.7 | 4.5 | 56.5 | 38.6 | 11.9 |

To measure the contrast between the first and second target surface areas, the color difference between these two areas can be calculated using the Equation (2), under illumination with either the primary illumination spectrum 910, or with the secondary illumination spectrum 920.

$$\Delta E=\sqrt{(L_2^*-L_1^*)^2+(a_2^*-a_1^*)^2+(b_2^*-b_1^*)^2} \quad (2)$$

For the first example, the outcome of Equation (2) for illumination with the primary illumination spectrum 920 is a color difference of 3.6, while for illumination with the secondary illumination spectrum 920, the color difference has increased to 11.8. So, in the first example a light source is used that can switch between two light outputs having the same color (color difference is equal to zero), but a different illumination spectrum. When this light source illuminates a white surface, no change in the appearance of this surface will be observed upon switching between the two light outputs. But when this light source illuminates a surface having two surface areas whose reflectance spectra differ in the same spectral region as wherein the illumination spectra differ, a change in contrast between these two surface areas will be observed upon switching between the two light outputs.

Figure 10:
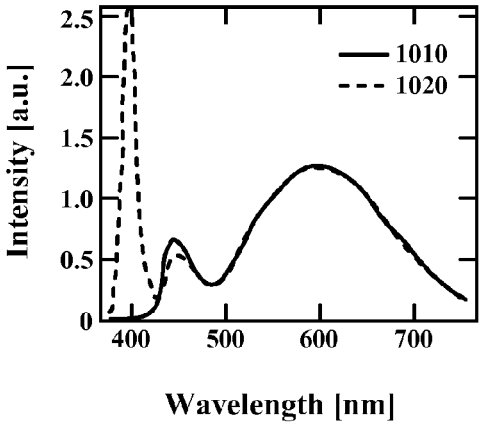
FIGS. 10*a* to 10*c* relate to a second example of an arrangement according to the invention, and show the primary and secondary illumination spectra of the primary and secondary light output, respectively (FIG. 10*a*), and spectral power distributions of the light that is returned from the first and second target surface areas upon illumination with the primary and secondary light outputs (FIGS. 10*b* and 10*c*)
Figure 10:
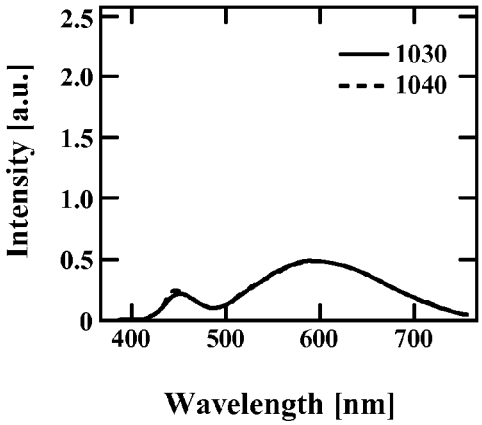
Figure 10:
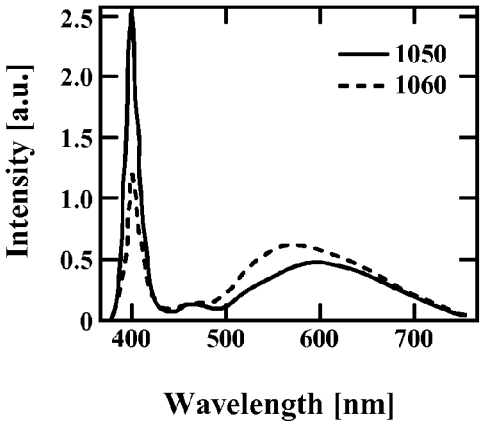

The second example relates to photoluminescence, and it is illustrated in FIG. 10. For the lighting device of the second example, the primary light output has a primary illumination spectrum 1010, and the secondary light output has a secondary illumination spectrum 1020, as shown in FIG. 10(*a*). It is clear that compared to the primary illumination spectrum 1010, the secondary illumination spectrum 1020 has a strong component centered around 400 nm. Apart from that, the primary and secondary illumination spectra 1010 and 1020 have a similar spectral distribution. Similar as in the first example, using the CIE standard observer color-mapping function the CIE 1931 XYZ values of the primary and secondary illumination spectra can be calculated, and from these values points in the CIE 1976 (L*a*b*) color space can be calculated.

| | X | Y | Z | L* | a* | b* |
|---|---|---|---|---|---|---|
| Primary illumination spectrum 1010 | 51.1 | 48.1 | 19.5 | 100.0 | 0.0 | 0.0 |
| Secondary illumination spectrum 1020 | 51.2 | 47.5 | 21.4 | 99.6 | 2.3 | −7.3 |

It is noted that the primary illumination spectrum 1010 has L*, a* and b* values 100, 0.0 and 0.0, respectively, because for the calculation of these values from the CIE 1931 XYZ values the primary illumination spectrum 1010 is used as reference. Using the above L*, a* and b* values, the color difference between the primary and secondary illumination spectra 1010 and 1020 is calculated to be 7.7. This means that irrespective of the actual switching pattern, the primary and secondary light outputs will always have a color difference that is lower than the predetermined threshold (which will be somewhere between 8 and 20), as was also the case in the first example.

In this second example the first and second target surface areas are chosen such that only the second target surface area comprises a phosphor that can be photoexcited with radiation of about 400 nm, i.e. within the spectral range wherein the primary and secondary illumination spectra 1010 and 1020, respectively, are markedly different. The particular phosphor used in this example has a luminescence emission band between 500 nm and 600 nm. Each of the first and second target surface areas can be illuminated with the primary light output and with the secondary light output. The spectral power distributions of the light that is returned from these first and second target surface areas upon such illumination can be measured with a spectroradiometer. It is noted that in this second example the light that is returned from the target surface areas contains reflected light and photoluminescence light. Light that is returned from the first target surface area upon illumination with the primary light output having primary illumination spectrum 1010 is measured to have spectral power distribution 1030. Spectral power distribution 1040 is measured for illumination of the second target surface area with the primary light output having primary illumination spectrum 1010. Light that is returned from the first target surface area upon illumination with the secondary light output having secondary illumination spectrum 1020 is measured to have spectral power distribution 1050. Spectral power distribution 1060 is measured for illumination of the second target surface area with the secondary light output having secondary illumination spectrum 1020.

The spectral power distributions 1030, 1040, 1050 and 1060 are shown in FIGS. 10(*b*) and 10(*c*). Spectral distributions 1030 and 1040 are almost identical. Spectral distributions 1050 and 1060 are different in the spectral region around 400 nm, and in the spectral region between 500 nm and 600 nm. Compared to spectral distribution 1050 (obtained when the first target surface area is illuminated with the secondary light output), spectral distribution 1060 (obtained when the second target surface area is illuminated with the secondary light output), has a reduced intensity in the spectral region around 400 nm (the human eye is relatively insensitive for radiation in this spectral region, and this radiation is partly absorbed by the phosphor) but an increased intensity in the spectral region between 500 nm and 600 nm (this is where the phosphor produces photoluminescence). In a similar way as for the first example, for each of the spectral power distributions 1030, 1040, 1050 and 1060 the CIE 1931 XYZ values can be calculated using the CIE standard observer color-mapping function, and from these CIE 1931 XYZ values, points in the CIE 1976 (L*a*b*) color space can be calculated.

| | First target surface area | | | Second target surface area | | |
|---|---|---|---|---|---|---|
| | X | Y | Z | X | Y | Z |
| Primary illumination spectrum 1010 | 37.2 | 35.3 | 14.6 | 38.1 | 36.2 | 13.3 |
| Secondary illumination spectrum 1020 | 37.2 | 34.9 | 15.6 | 42.2 | 42.5 | 13.8 |

| | First target surface area | | | Second target surface area | | |
|---|---|---|---|---|---|---|
| | $L_1$* | $a_1$* | $b_1$* | $L_2$* | $a_2$* | $b_2$* |
| Primary illumination spectrum 1010 | 88.6 | −0.9 | −1.4 | 89.6 | −1.7 | 5.8 |
| Secondary illumination spectrum 1020 | 88.7 | −1.4 | 0.7 | 95.8 | −13.0 | 20.3 |

As a measure for the contrast between the first and second target surface areas, one can calculate the color difference between these two areas using the same equation as used before, under illumination with either the primary illumination spectrum 1010, or with the secondary illumination spectrum 1020. The outcome of such a calculation for illumination with the primary illumination spectrum 1010 is a color difference of 7.3. For illumination with the secondary illumination spectrum 1020, the color difference has increased to 23.9. So, in the second example a light source is used that can switch between two light outputs having a color difference that is lower than the predetermined threshold, while having a different illumination spectrum. When this light source illuminates a white surface, the appearance of this surface will not markedly change upon switching between the two light outputs. But when this light source illuminates a surface having two surface areas of which one comprises a phosphor that can be photoexcited with radiation that is predominantly present in only one of the illumination spectra, a change in contrast between these two surface areas will be observed upon switching between the two light outputs.

Figure 11:
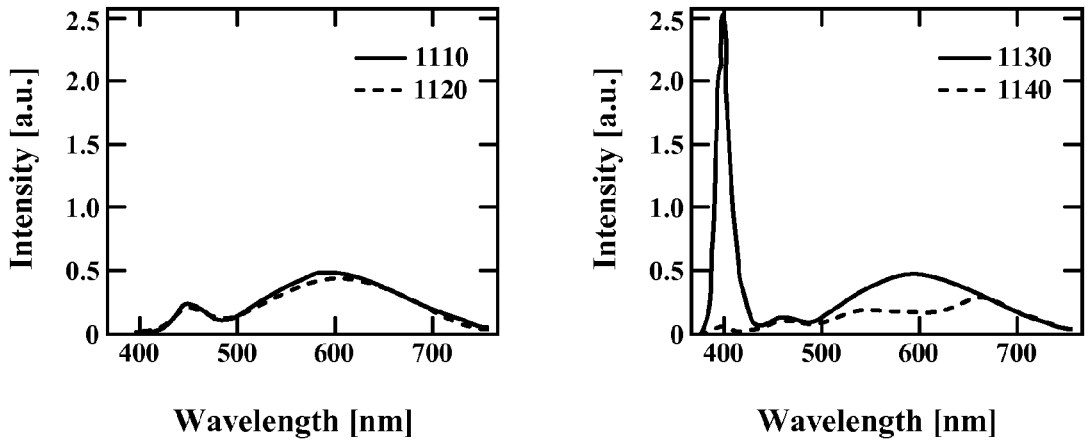
FIGS. 11*a* and 11*b* relate to a third example of an arrangement according to the invention, and show the spectral power distributions of the light that is returned from the first and second target surface areas upon illumination with the primary and secondary light outputs.

The third example relates to photochromism, and it is illustrated in FIG. 11. The light source used in this third example is the same as that used for the second example. In other words, the primary light output again has a primary illumination spectrum 1010, and the secondary light output again has a secondary illumination spectrum 1020. So also in this example, irrespective of the actual switching pattern, the primary and secondary light outputs will always have a color difference that is lower than the predetermined threshold.

In this third example the first and second target surface areas are chosen such that only the second target surface area comprises a material that can undergo a reversible transformation upon absorption of radiation of about 400 nm, i.e. within the spectral range wherein the primary and secondary illumination spectra 1010 and 1020, respectively, are markedly different. Upon absorption of such radiation, the material comprised in the second target surface area transforms from a first state into a second state, wherein compared to the first state, the second state has an increased capability of absorbing radiation in the yellow/green part of the spectrum, so that when the material is in the second state it will have a blueish appearance. This is apparent from the spectral power distributions of the light that is returned from these first and second target surface areas upon illumination with the primary light output and with the secondary light output. Light that is returned from the first target surface area upon illumination with the primary light output having primary illumination spectrum 1010 is measured to have spectral power distribution 1110. Spectral power distribution 1120 is measured for illumination of the second target surface area with the primary light output having primary illumination spectrum 1010. Light that is returned from the first target surface area upon illumination with the secondary light output having secondary illumination spectrum 1020 is measured to have spectral power distribution 1130. Spectral power distribution 1140 is measured for illumination of the second target surface area with the secondary light output having secondary illumination spectrum 1020.

The spectral power distributions 1110, 1120, 1130 and 1140 are shown in FIGS. 11(*a*) and 11(*b*). Similar as for the first and second examples, for each of the spectral power distributions 1110, 1120, 1130 and 1140, the CIE 1931 XYZ values can be calculated using the CIE standard observer color-mapping function, and from these CIE 1931 XYZ values, points in the CIE 1976 (L*a*b*) color space can be calculated.

| | First target surface area | | | Second target surface area | | |
|---|---|---|---|---|---|---|
| | X | Y | Z | X | Y | Z |
| Primary illumination spectrum 1010 | 37.2 | 35.3 | 14.6 | 33.4 | 31.2 | 11.6 |
| Secondary illumination spectrum 1020 | 37.2 | 34.9 | 15.6 | 23.9 | 22.8 | 9.0 |

| | First target surface area | | | Second target surface area | | |
|---|---|---|---|---|---|---|
| | $L_1$* | $a_1$* | $b_1$* | $L_2$* | $a_2$* | $b_2$* |
| Primary illumination spectrum 1010 | 88.6 | −0.9 | −1.4 | 84.4 | 1.2 | 4.6 |
| Secondary illumination spectrum 1020 | 88.7 | −1.4 | 0.7 | 74.8 | −3.6 | 6.8 |

As a measure for the contrast between the first and second target surface areas, one can calculate the color difference between these two areas using the same equation as used before, under illumination with either the primary illumination spectrum 1010, or with the secondary illumination spectrum 1020. The outcome of such a calculation for illumination with the primary illumination spectrum 1010 is a color difference of 7.6. For illumination with the secondary illumination spectrum 1020, the color difference has increased to 15.3. So, in the third example a light source is used that can switch between two light outputs having a color difference that is lower than the predetermined threshold, while having a different illumination spectrum. When this light source illuminates a white surface, the appearance of this surface will not markedly change upon switching between the two light outputs. But when this light source illuminates a surface having two surface areas of which one comprises a material that can, upon absorption of radiation that is predominantly present in only one of the illumination spectra, reversibly transform from a first state into a second state having a different color than the first state, a change in contrast between these two surface areas will be observed upon switching between the two light outputs.

Figure 12:
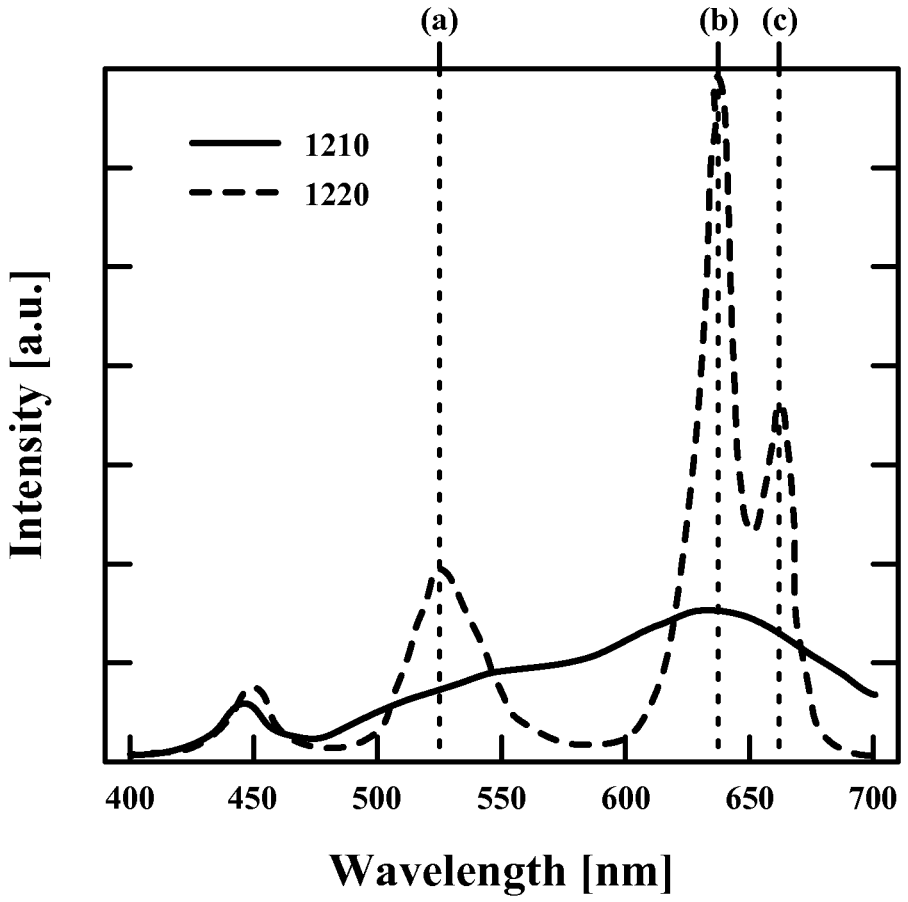
FIG. 12 shows the primary and secondary illumination spectra of a lighting device for use in the arrangement of the present invention.

Further to the three examples described above, FIG. 12 shows the primary illumination spectrum 1210 and the secondary illumination spectrum 1220 of a lighting device for use in the arrangement of the present invention. Both illumination spectra represent a white color having a correlated color temperature in a range between 2700 K and 6500 K, and the color difference between the two colors is lower than the predetermined threshold ($\Delta E_T$). In each of the green spectral region (a), the red spectral region (b) and the deep red spectral region (c), the peak intensity of the secondary illumination spectrum 1220 is at least a factor of two higher than the peak intensity of the primary illumination spectrum 1210 in each of these regions.

While the invention has been illustrated and described in detail in the drawings and foregoing description, such illustration and description are to be considered illustrative or exemplary and not restrictive; the invention is not limited to the disclosed embodiments. Variations to the disclosed embodiments can be understood and effected by those skilled in the art in practicing the claimed invention, from a study of the drawings, the disclosure, and the appended claims. In the claims, the word "comprising" does not exclude other elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. An arrangement comprising a lighting system and a target object, the lighting system being arranged to illuminate a target surface of the target object with a primary light output having a primary illumination spectrum representing a first color, and with a secondary light output having a secondary illumination spectrum representing a second color, wherein the primary and secondary illumination spectra have different spectral power distributions, and wherein the first and second colors have a color difference that is equal to or lower than a predetermined threshold ($\Delta E_T$) that is the lower of 20 and the outcome of the following equation:

$$\Delta E_T = \Delta E_0 + \alpha \Delta t$$

wherein $\Delta E_0$ is equal to 8, $\alpha$ is equal to 8 per second, and $\Delta t$ represents the shortest time it takes the illumination of an arbitrary area on the target surface to change between the primary light output and the secondary light output, and the target surface comprising a first target surface area and a second target surface area, wherein upon illumination with the primary illumination spectrum, the first target surface area has a primary first color and the second target surface area has a primary second color, and the first and second target surface areas have a first contrast, and upon illumination with the secondary illumination spectrum, the first target surface area has a secondary first color and the second target surface area has a secondary second color, and the first and second target surface areas have a second contrast, the second contrast being larger than the first contrast, and the term "contrast" referring to the color difference of the first and second target surface areas, and for two colors in CIE 1967 (L*a*b*) color space, the color difference is given by $$\Delta E=\sqrt{(L_2^*-L_1^*)^2+(a_2^*-a_1^*)^2+(b_2^*-b_1^*)^2} \quad (2)$$

where $L_1^*$ and $L_2^*$ respectively refer to lightness of the two colors, $a_1^*$ and $b_1^*$ relate to chromaticity of one color, $a_2^*$ and $b_2^*$ relate to chromaticity of the other color.

2. The arrangement according to claim 1, wherein the primary first and second colors, and the secondary first color are substantially the same but different from the secondary second color.

3. The arrangement according to claim 1, wherein the primary and secondary first colors are substantially the same but different from the primary and secondary second colors.

4. The arrangement according to claim 2, wherein the first target surface area has a first reflectance spectrum, and the second target surface area has a second reflectance spectrum, wherein the product of the primary illumination spectrum and the first reflectance spectrum, the product of the primary illumination spectrum and the second reflectance spectrum, and the product of the secondary illumination spectrum and the first reflectance spectrum have substantially the same spectral power distribution within the visible spectrum, and wherein the product of the secondary illumination spectrum and the second reflectance spectrum has a different spectral power distribution.

5. The arrangement according to claim 2, wherein the second target surface area comprises a photoluminescent material that can be excited with light that is present in one of the primary and secondary illumination spectra.

6. The arrangement according to claim 2, wherein the second target surface area comprises a photochromic material that has a primary reflectance spectrum when illuminated with the primary light output and a secondary reflectance spectrum when illuminated with the secondary light output, the secondary reflectance spectrum being different from the primary reflectance spectrum.

7. The arrangement according to claim 1, wherein the first and second target surface areas have metameric colors, and wherein the second contrast is different from the first contrast due to metameric failure.

8. The arrangement according to claim 1, wherein the lighting system is arranged to illuminate the second target surface area with a time-varying secondary light output.

9. The arrangement according to claim 1, wherein the arrangement is part of a retail environment, and wherein the target object is either a good or a sign in the retail environment.

10. A lighting device for use in the arrangement of claim 1, the lighting device being arranged to provide the primary light output and the secondary light output.

11. The lighting device according claim 10, wherein the lighting device is arranged to be operated in a first mode for providing the primary light output and in a second mode for providing the secondary light output, the lighting device further comprising a switching controller for switching between the first and second modes.

12. The lighting device according to claim 10, wherein, in operation, the primary and secondary light outputs are directed into different directions.

13. The lighting device of claim 12, further comprising a directionality controller for dynamically changing the directions of the primary and secondary light outputs.

14. The lighting device according to claim 10, wherein the primary illumination spectrum consists of light with wavelengths in the visible part of the electromagnetic spectrum, and wherein the secondary illumination spectrum comprises light with wavelengths in the ultraviolet and/or infrared part of the electromagnetic spectrum.

15. The lighting device according to claim 10, wherein the primary light output is provided by a first light source, and wherein the secondary light output is provided by a second light source or by a combination of the first light source and the second light source.

* * * * *